US007710351B2

(12) United States Patent
Sano et al.

(10) Patent No.: US 7,710,351 B2
(45) Date of Patent: May 4, 2010

(54) LOAD DRIVE CIRCUIT AND DISPLAY DEVICE USING THE SAME

(75) Inventors: Yuji Sano, Kawasaki (JP); Toyoshi Kawada, Kawasaki (JP); Yoshinori Okada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 1545 days.

(21) Appl. No.: 10/948,300

(22) Filed: Sep. 24, 2004

(65) Prior Publication Data

US 2005/0068266 A1 Mar. 31, 2005

(30) Foreign Application Priority Data

Sep. 26, 2003 (JP) ..... 2003-335109
Jul. 2, 2004 (JP) ..... 2004-197142

(51) Int. Cl.
*G09G 3/28* (2006.01)

(52) U.S. Cl. ..... 345/60; 345/63; 315/169.4

(58) Field of Classification Search ..... 345/63, 345/60, 76, 87, 211; 330/9, 253; 315/169.4; 327/108, 327, 328; 323/277
See application file for complete search history.

(56) References Cited

U.S. PATENT DOCUMENTS

| | | | | |
|---|---|---|---|---|
| 6,624,798 | B1 | 9/2003 | Aoki et al. | 345/60 |
| 6,897,726 | B2 * | 5/2005 | Tsuchi | 330/253 |
| 7,180,939 | B2 * | 2/2007 | Palaskas et al. | 375/229 |
| 7,224,224 | B2 * | 5/2007 | Sera et al. | 330/253 |
| 2002/0047552 | A1 | 4/2002 | Sano et al. | |

FOREIGN PATENT DOCUMENTS

| | | |
|---|---|---|
| JP | 5-249916 | 9/1993 |

* cited by examiner

*Primary Examiner*—Abbas I Abdulselam
(74) *Attorney, Agent, or Firm*—Staas & Halsey LLP

(57) ABSTRACT

A load drive circuit, successfully suppressed in unnecessary electromagnetic wave generation through suppressing transition time in the drive voltage waveform even under a reduced effective load, and a display device using this circuit are provided, wherein the circuit comprises a drive circuit inversively amplifying a signal, used for driving a load, input through an input terminal, and output from an output terminal; a first current source connected to the input terminal of the drive circuit and being capable of controlling current output; and a first switch circuit connected between the input terminal of the drive circuit and a first reference potential point.

20 Claims, 16 Drawing Sheets

LOAD DRIVE CIRCUIT AND DISPLAY DEVICE USING THE SAME

CROSS-REFERENCE TO RELATED APPLICATIONS

This application is based upon and claims the benefit of priority from the prior Japanese Patent Application Nos. 2003-335109, filed on Sep. 26, 2003 and 2004-197142, filed on Jul. 2, 2004, the entire contents of which are incorporated herein by reference.

BACKGROUND OF THE INVENTION

1. Field of the Invention

The present invention relates to a load drive circuit and a display device, and in particular to a drive circuit and a display device successfully reduced in unnecessary radiation in operation of any display panel, which acts as a load, such as plasma display electro-luminescence display and liquid crystal display (LCD).

2. Description of the Related Art

FIG. 10 is a schematic drawing of a three electrode surface discharge AC-driven plasma display panel, and FIG. 11 is a sectional view for explaining the electrode structure of the plasma display panel shown in FIG. 10. In FIGS. 10 and 11, reference numeral 207 denotes a discharge cell (display cell), 210 denotes a rear glass substrate, 211 and 221 denote dielectric layers, 212 denotes a fluorescent material, 213 denotes a diaphragm, 214 denotes address electrodes (A1 to Ad), 220 denotes a front glass substrate, and 222 denotes X electrodes (X1 to XL) or Y electrodes (Y1 to YL). Reference symbol Ca denotes capacitance between the adjacent address electrodes, and Cg denotes capacitance between the opposing address electrodes (X electrode and Y electrode).

A plasma display panel 201 comprises two glass substrates of the rear glass substrate 210 and the front glass substrate 220, and the front glass substrate 220 has the X electrodes (X1, X2, . . . , XL) and the Y electrodes (scanning electrodes: Y1, Y2, to YL) disposed thereon as sustaining electrodes (including bus electrode and transparent electrode).

The rear glass substrate 210 has the address electrodes (A1, A2, . . . , Ad) 214 disposed thereon so as to cross normal to the sustaining electrodes (X electrodes and Y electrodes) 222, and the display cell 207 causing discharge light emission with the aid of these electrodes is formed in each area which falls between the X electrode and Y electrode having the same number (Y1-X1, Y2-X2, . . . ), and on the intersection with the address electrode.

FIG. 12 is a block diagram showing an entire configuration of a plasma display device using the plasma display panel shown in FIG. 10, and more specifically showing an essential portion of a drive circuit for the display panel.

As shown in FIG. 12, the three electrode surface discharge, AC-driven plasma display device comprises the display panel 201, a control circuit 205 for generating a control signal for controlling the drive circuit of the display panel in response to an externally-input interface signal, an X common driver (X electrode drive circuit) 206 for driving the panel electrodes using the control signal from the control circuit 205, a scanning electrode drive circuit (scan driver) 203 and Y common driver 204, and an address electrode drive circuit (address driver) 202.

The X common driver 206 generates sustaining voltage pulse, the Y common driver 204 similarly generates sustaining voltage pulse, and the scan driver 203 effects scanning by independently driving the individual scan electrodes (Y1 to YL). The address driver 202 applies an address voltage pulse to the individual address electrodes (A1 to Ad) corresponding to display data.

The control circuit 205 has a display data control section 251 for supplying an address control signal to the address driver 202 upon receiving of clock CLK and display data DATA, a scan driver control section 253 for controlling the scan driver 203 upon receiving of vertical synchronizing signal Vsync and horizontal synchronizing signal Hsync, and a common driver control section 254 for controlling common drivers (X common driver 206 and Y common driver 204). The display data control section 251 has a frame memory 252.

FIG. 13 is a drawing showing an exemplary drive waveform of the plasma display device shown in FIG. 12, and shows outlines of voltage waveforms applied to the individual electrodes in the all-write period (AW), all-erasure period (AE), address period (ADD) and sustaining period (sustained discharge period: SUS).

In FIG. 13, drive periods directly related to image display are the address period ADD and sustaining period SUS, where a pixel to be displayed is selected in the address period ADD, and the selected pixel is then kept in an emission state so as to allow image display in a predetermined brightness. It is to be noted that FIG. 13 shows drive waveforms of the individual sub-frames for the case where one frame is composed of a plurality of subframes (sub-field).

First, in the address period ADD, all of the Y electrodes (Y1 to YL), which are scanning electrodes, are applied with an intermediate potential −Vmy en bloc, and then sequentially applied with a scanning voltage pulse of −Vy level as being switched from −Vmy. In this process, pixels on the individual scanning lines can be selected by applying an address voltage pulse of +Va level to the individual address electrodes (electrode A: A1 to Ad) in synchronization with the application of the scanning pulses to the individual Y electrodes.

In the succeeding sustaining period SUS, all of the scanning electrodes (Y1 to YL) and X electrodes (X1 to XL) are alternately applied with a sustaining voltage pulse of +Vs level, so as to induce sustained emission at the previously selected pixels, and to allow display at a predetermined luminance through such successive application. It is also made possible to effect gradation display by controlling the number of times of light emission by combining basic operations expressed by such series of operation waveforms.

The all-write period AW is provided for applying a write voltage pulse to all of the display cells in the panel so as to activate the individual display cells and to keep the display characteristics uniform, and is inserted at certain constant intervals. The all-erasure period AE is provided for erasing previous display contents before the address operation and sustaining operation for image display are newly commenced, through application of an erasure voltage pulse to all of the display cells on the panel.

FIG. 14 shows an exemplary circuit diagram of the address drive circuit used for the address driver 202 of the plasma display device shown in FIG. 12. The address electrode drive circuit shown in FIG. 14 is disclosed typically in Patent Document 1 below. The address electrode can be assumed as a capacitive load 100 as shown in the drawing, because most of the current components flow through the address electrodes (A1 to Ad) are charge-discharge current for parasitic capacitance of the electrodes.

[Patent Document 1] Japanese Patent Application Laid-Open No. 5-249916

Assuming now that the number of the address electrodes (A1 to Ad) of the display panel reaches as much as 3072 (1024 pixels×RGB), the circuit is configured so that the outputs of 24 drive ICs, each having 128 address electrode drive circuit shown in FIG. 14 integrated therein, are connected to the address electrodes. The connection to the address electrodes is made typically through a flexible substrate on which the drive ICs are mounted in a unit of a single chip or two or more chips.

In the circuit diagram shown in FIG. 14, a single address electrode corresponds to the capacitive load 100. A low-side output element (N-channel MOSFET) 101 is connected between the ground, which is a low-voltage-side reference potential, and the capacitive load 100. A high-side output element (P-channel MOSFET) 102 is connected between a drive power source 107, capable of supplying high-voltage potential Va which corresponds to high-level of the address drive voltage, and the capacitive load 100.

As an exemplary circuit for driving the high-side output element 102, FIG. 14 shows a level shift circuit 108. The level shift circuit 108 drives the high-side output element 102 with the aid of an inverter circuit which comprises a P-channel MOSFET 103 and an N-channel MOSFET 104. The P-channel MOSFET 103 is driven by flip-flop operation of another inverter circuit which comprises a P-channel MOSFET 105 and an N-channel MOSFET 106.

Operation in the address period ADD (FIG. 13) will be explained referring to a timing chart shown in FIG. 15. FIG. 15 shows timing relations between output voltage Vo of the address electrode drive circuit and input voltages VG1 to VG6 of the individual drive elements 101 to 106. In a rise-up period AT of output voltage Vo, the low-side output element 101 is cut off by inverting input voltage VG1 from high level to the low level, and the high-side output element 102 is turned on by inverting input voltage VG4 into the high level and input voltage VG6 into the low level. This adjusts output voltage Vo to high voltage potential Va. On the contrary, in the decay period TB of output voltage Vo, the high-side output element 102 is cut off by inverting input voltage VG4 into the low level and input voltage VG6 into the high level, and the low-side output element 101 is turned on by inverting input voltage VG1 into the high level. This adjusts output voltage Vo to the ground level (0V).

The rise-up time and decay time as seen in the waveform of output voltage Vo shown in FIG. 15 refer to times for charging and discharging the load capacitance 100 with the output currents from the high-side output element 102 and low-side output element 101. It is to be noted herein that the adjacent address electrodes on the display panel 201 shown in FIG. 11 are switched between high-voltage potential Va and the ground level depending on image to be displayed. The load capacitance 100 in this case therefore can largely vary and affect as follows. For the case where the adjacent electrodes placed on the left and right sides of a target address electrode are switched at the same time in the same direction (i.e., together from the ground level to high-voltage potential Va), the load capacitance 100 will have a minimum value as being contributed only by capacitance Cg without including capacitance Ca between the adjacent electrodes which are in no need of charge nor discharge. On the contrary, for the case where the left and right adjacent electrodes are switched at the same time in the opposite directions (i.e., one varies from the ground level to high-voltage potential Va, and the other varies from high-voltage potential Va to the ground level), the capacitive load 100 will have a maximum value of Cg+4Ca because both capacitances Ca between the adjacent electrodes will be supplied with doubled electric charge. Ratio of variation in the load capacitance 100 therefore reaches three times or more in general. Output currents from the high-side output element 102 and low-side output element 101 must be designed as being sufficiently large so as to successfully obtain a drive speed necessary for the display panel 201. This, however, results in a sharp change in the waveform of output voltage Vo under the minimum load and consequently in a drastic decrease in the transition time, and therefore raises a problem of increase in unnecessary electromagnetic radiation ascribable thereto. Interference of any other electronic instruments caused by unnecessary electromagnetic wave is known as EMI (electromagnetic interference), and is necessarily suppressed to a level allowable by any specified standards. In general procedures for suppressing unnecessary radiation, lack of suppressive measures in the initial stage of the design will unfortunately increase costs for any additional electromagnetic shield or filter elements.

SUMMARY OF THE INVENTION

It is therefore objects of the present invention to provide a load drive circuit capable of suppressing generation of unnecessary electromagnetic wave by suppressing reduction in transition time in the operation voltage waveform even under reduced effective load, and to provide a display device using this drive circuit.

One aspect of the present invention is successful in providing a load drive circuit and a display device using the same, where the load drive circuit comprises a drive circuit for inversively amplifying a signal, used for driving a load, input through an input terminal, and output from an output terminal; a first current source connected to the input terminal of the drive circuit and being capable of controlling current output; and a first switch circuit connected between the input terminal of the drive circuit and a first reference potential point.

DETAILED DESCRIPTION OF THE PREFERRED EMBODIMENTS

First Embodiment

Figure 1:
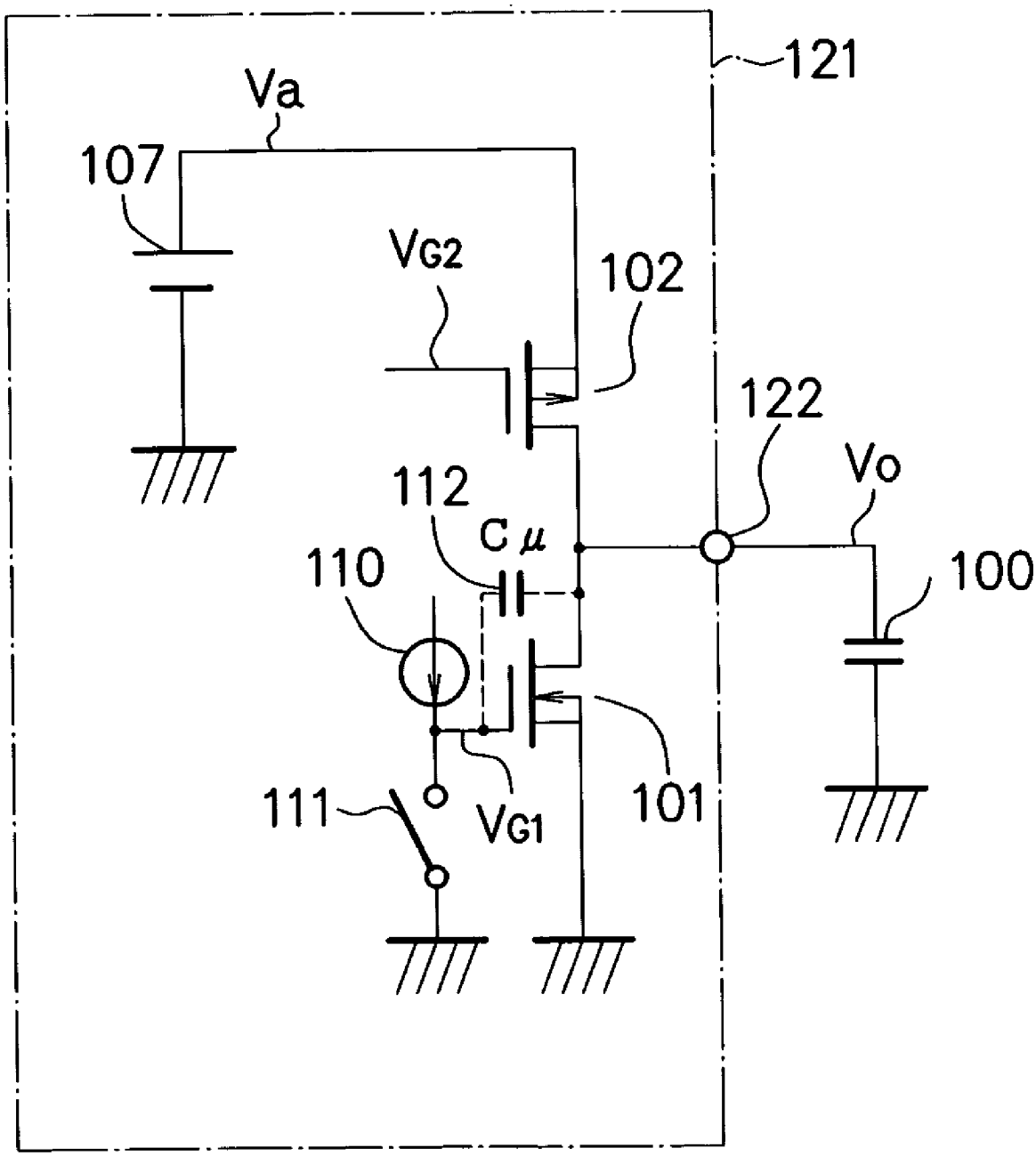
FIG. 1 is a circuit diagram of a load drive circuit according to a first embodiment of the present invention.
Figure 14:
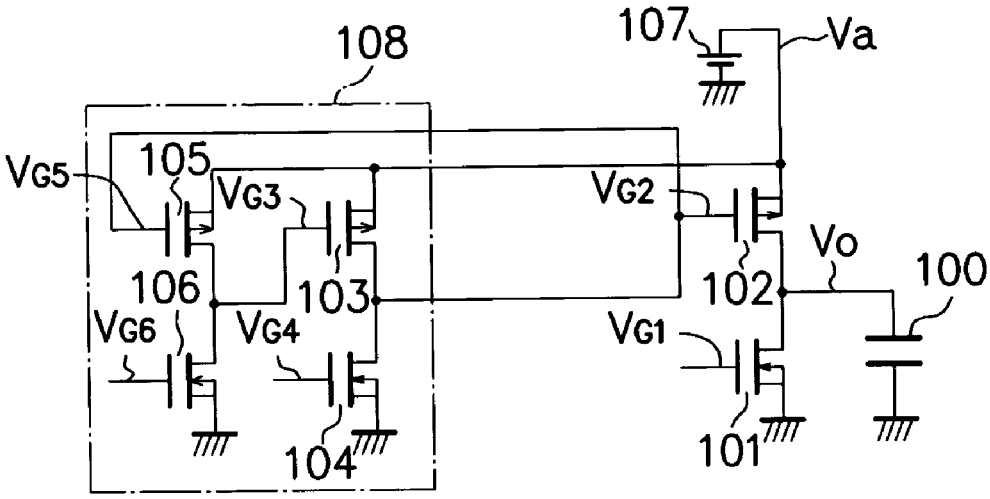
FIG. 14 PRIOR ART
FIG. 14 is a circuit diagram showing a circuit configuration of a conventional capacitive load drive circuit.
Figure 15:
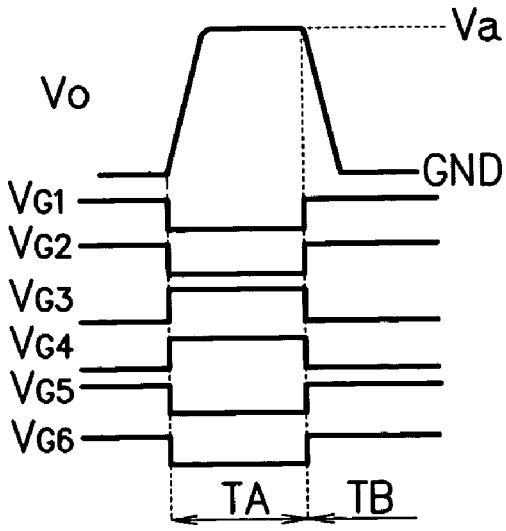
FIG. 15 PRIOR ART
FIG. 15 is a timing chart explaining operations of a conventional capacitive load drive circuit.

FIG. 1 is a circuit diagram of a load drive circuit successful in suppressing load-variation-induced changes in the drive speed, according to the first embodiment of the present invention. An integrated circuit (IC) 121 comprises an N-channel MOS (Metal Oxide Semiconductor) field effect transistor (referred to as FET, hereinafter) 101, a P-channel MOSFET 102, a drive power source 107, a current source 110 and a switch circuit 111. The integrated circuit 121 corresponds to the address driver 202 in FIG. 12. The load capacitance 100 corresponds to the load capacitance of the address electrodes A1 to Ad in FIG. 12, similarly to as described with regard to the aforementioned capacitive load 100 in FIG. 14, and can effectively vary. The load drive circuit of this embodiment is typically applicable to plasma display devices. Description on the plasma display device may be the same with the description already given in relation to FIGS. 10 to 13.

The N-channel MOSFET 101 has the gate connected to the current source 110, the source to the ground potential point, and the drain to an output terminal 122. The current source 110 is capable of controlling current output. The switch circuit 111 is connected between the gate of the N-channel MOSFET 101 and the ground potential point. The P-channel MOSFET 102 has the source connected to an anode of the drive power source 107, and the drain to the output terminal 122 together with the drain of the MOSFET 101. The drive power source 107 has a cathode at the ground potential and an anode at a high-voltage positive potential Va. A parasitic capacitance 112 has a capacitance value of Cμ, and resides between the drain and gate of the N-channel MOSFET 101. The load capacitance 100 is that of the address electrodes, and is expressed by capacitance between the output terminal 122 and the ground potential point.

Input voltage VG1 is an input voltage applied to the gate of the N-channel MOSFET 101. Input voltage VG2 is an input voltage applied to the gate of the P-channel MOSFET 102. Output voltage Vo is a voltage of the output terminal 122, that is, an output voltage of the MOSFETs 101 and 102.

The N-channel MOSFET 101 is a low-side output element and the P-channel MOSFET 102 is a high-side output element, where these elements are by no means limited to MOSFET, but may be IGBT (insulated gate bipolar transistor) or bipolar transistor. The output elements 101 and 102 subject a signal input to the input terminal, which is equivalent to the gate, to inverting amplification, and output the resultant output signal from the output terminal which is equivalent to the drain. This makes it possible for the output elements 101 and 102 to drive the variable load 100.

As shown in FIG. 1, the load drive circuit which comprises the high-side output element 102, low-side output element 101 and the drive power source 107 drives the effectively variable load capacitance 100 which corresponds with electrodes on the display panel. The input terminal of the low-side output element 101 is connected with the current source 110 and the switch circuit 111 which comprises an active element such as MOSFET. A value of the parasitic capacitance 112 between the input and output terminals of the low-side output element 101 is now defined as Cμ.

Figure 2:
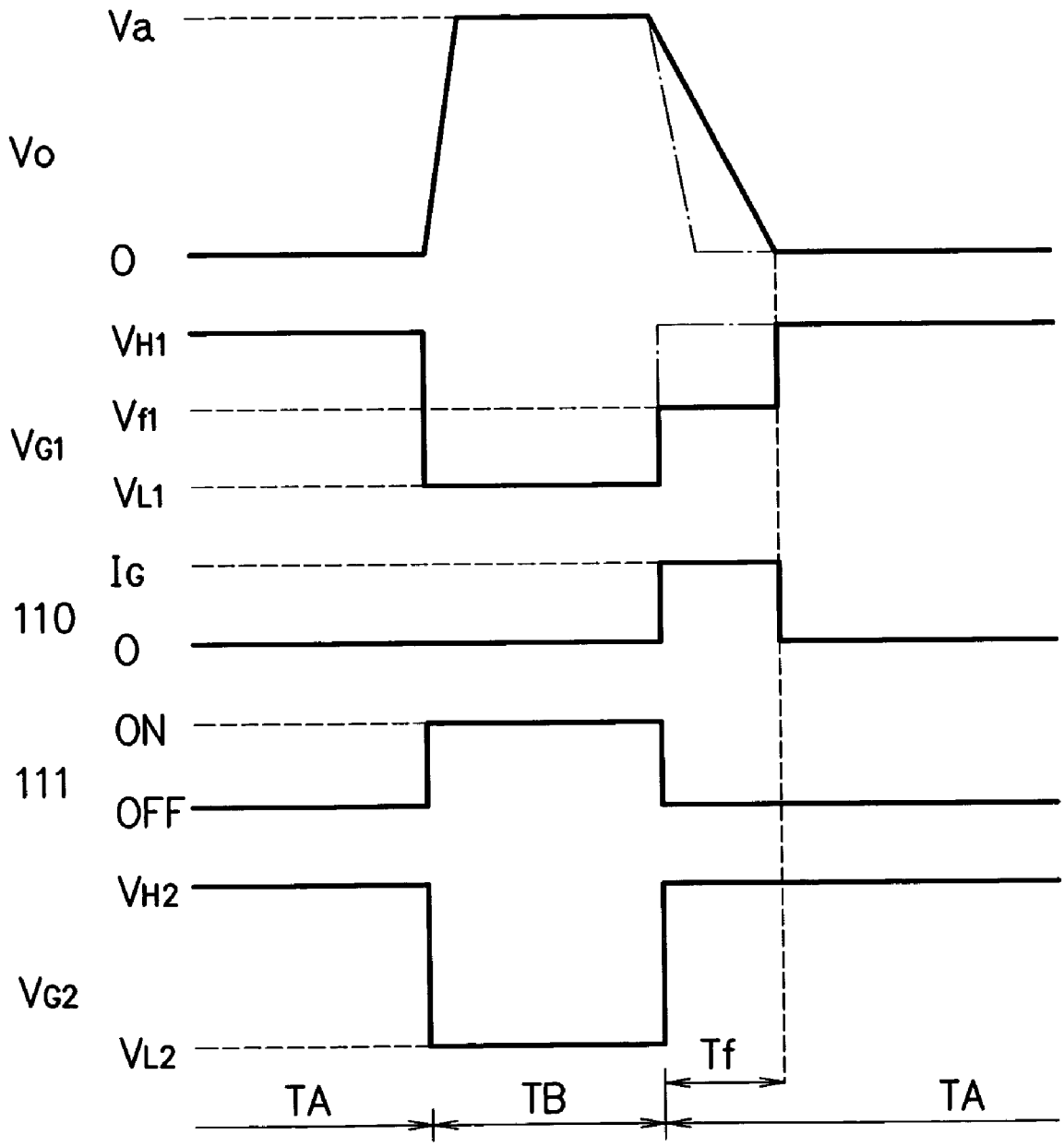
FIG. 2 is a timing chart explaining circuit operation according to the first embodiment of the present invention.

Operation during the address period ADD (FIG. 13) of the circuit shown in FIG. 1 will be explained referring to the timing chart of FIG. 2. FIG. 2 shows, from the top to the bottom, output voltage Vo, input voltage VG1, output current of the current source 110, ON/OFF signal of the switch circuit 111, and input voltage VG2.

In the rise-up period TB in which output voltage Vo rises up to high-voltage potential Va (e.g., 60 V), the low-side output element 101 is first cut off by switching the switch circuit 111 from OFF to ON to thereby lower input voltage VG1 of the low-side output element 101 to low-voltage potential VL1 (e.g., 0 V). The high-side output element 102 is then turned on by lowering input voltage VG2 to low-voltage potential VL2 (e.g., 0 V). This raises output voltage Vo to high-voltage potential Va.

In the decay period TA in which output voltage Vo is lowered from high-voltage potential Va to the ground level, the high-side output element 102 is quickly cut off by quickly raising input voltage VG2 to high-voltage potential VH2 (e.g., 60 V). At the same time, also the switch circuit 111 is cut off. It is, however, allowable to turn the switch circuit 111 off before the high-side output element is cut off, provided that output voltage Vo can stably be sustained at high-voltage potential Va, and that through current can successfully be prevented from generating by cutting the low-side output element 101 off. Supply of gate current IG thereafter from the current source 110 in the direction of turning the low-side output element 101 on raises input voltage VG1 of the low-side output element 101 to the threshold voltage thereof, and sustains it nearly at a constant voltage of Vf1 by virtue of negative feedback through a feedback capacitance 112. Over the period Tf of the negative feedback, output voltage Vo lowers from high-voltage potential Va to the ground level at a nearly constant through rate. So far as the drive current of the load 100 is suppressed equal to or lower than the current ability of the low-side output element 101, the period Tf of the negative feedback is controlled so as to be kept at a constant duration of time irrespective of changes in the load 100 (typically at VaCμ/IG, for the case where difference between input voltage VL1 (e.g., 0 V) and VH1 (e.g., 5 V) is small enough so that it is negligible as compared with high-voltage potential Va (e.g., 60V). Voltage Vf1 varies depending on level of the capacitive load 100. Larger capacitive load 100 results in higher voltage Vf1, and smaller capacitive load 100 results in lower voltage Vf1, where duration of the period Tf during which output voltage Vo falls from high-voltage potential Va to the ground level is kept almost constant irrespective of changes in the capacitive load 100.

It is therefore obvious that use of the drive circuit shown in FIG. 1 is successful in suppressing reduction in the transition time in the drive voltage waveform which can occur when the load 100 effectively reduces, and consequently in suppressing generation of any unnecessary electromagnetic wave. On the contrary, use of the drive circuit shown in FIG. 14 may result in a sharp rise-up waveform of input voltage VG1 of the low-side output element 101 and in a sharp decay waveform of output voltage Vo as indicated by dashed lines in FIG. 2, and this raises anticipation of the unnecessary radiation. Because the current source 110 is generally configured by using a low-voltage drive power source for the low-side output element 101, current IG of the current source 110 automatically falls to zero when input voltage VG1 of the low-side output element 101 reaches VH1 (e.g., 5V).

Input voltages VG1 and VG2, low-voltage potentials VL1 and VL2, and high-voltage potentials VH1 and VH2 of the individual output elements herein are variable from the ground level to low-voltage power source voltage for logic circuit (e.g., 3 V or 5 V) and high-voltage potential Va (approximately several-tens volt), depending on designs of the low-side output element 101 and high-side output element 102. For an exemplary case where MOSFET or IGBT is used as the output element, they can be controlled based on design of thickness of the gate insulating film or W (width)/L (length) of the gate region.

It is to be noted that other general switching elements such as IGBTs or bipolar transistors are of course applicable to the output elements, although MOSFETs are used therefor in FIG. 1. It is also of course allowable to adopt a totem pole configuration based on the same polarity, although FIG. 1 showed a complimentary configuration in which the output elements on the high side and low side have opposite polarities.

For the case where the number of the drive electrodes of the display device is relatively small, such as in CRT display, the drive circuit shown in FIG. 1 can be configured by a discrete component. On the other hand, it is more practical to use a multi-output IC 121 in which a plurality of the single-load drive circuits shown in FIG. 1 are integrated, for the purpose of driving a large number of electrodes such as those formed on the plasma display panel.

FIG. 1 exemplified the capacitive load such as drive electrode used for display panels of plasma display device, liquid crystal display device and inorganic EL display device; and cathode ray tube of CRT display device. Also in cathode ray tube, parasitic capacitance among the individual drive electrodes for the primary colors can vary in an effective manner. The drive circuit of the present invention is, however, still successful in achieving similar effects on the display panel of current-driven organic EL display device, because the circuit can apply negative feedback also to resistive load such as electrodes on the display panel of this kind of display device.

Second Embodiment

Figure 3:
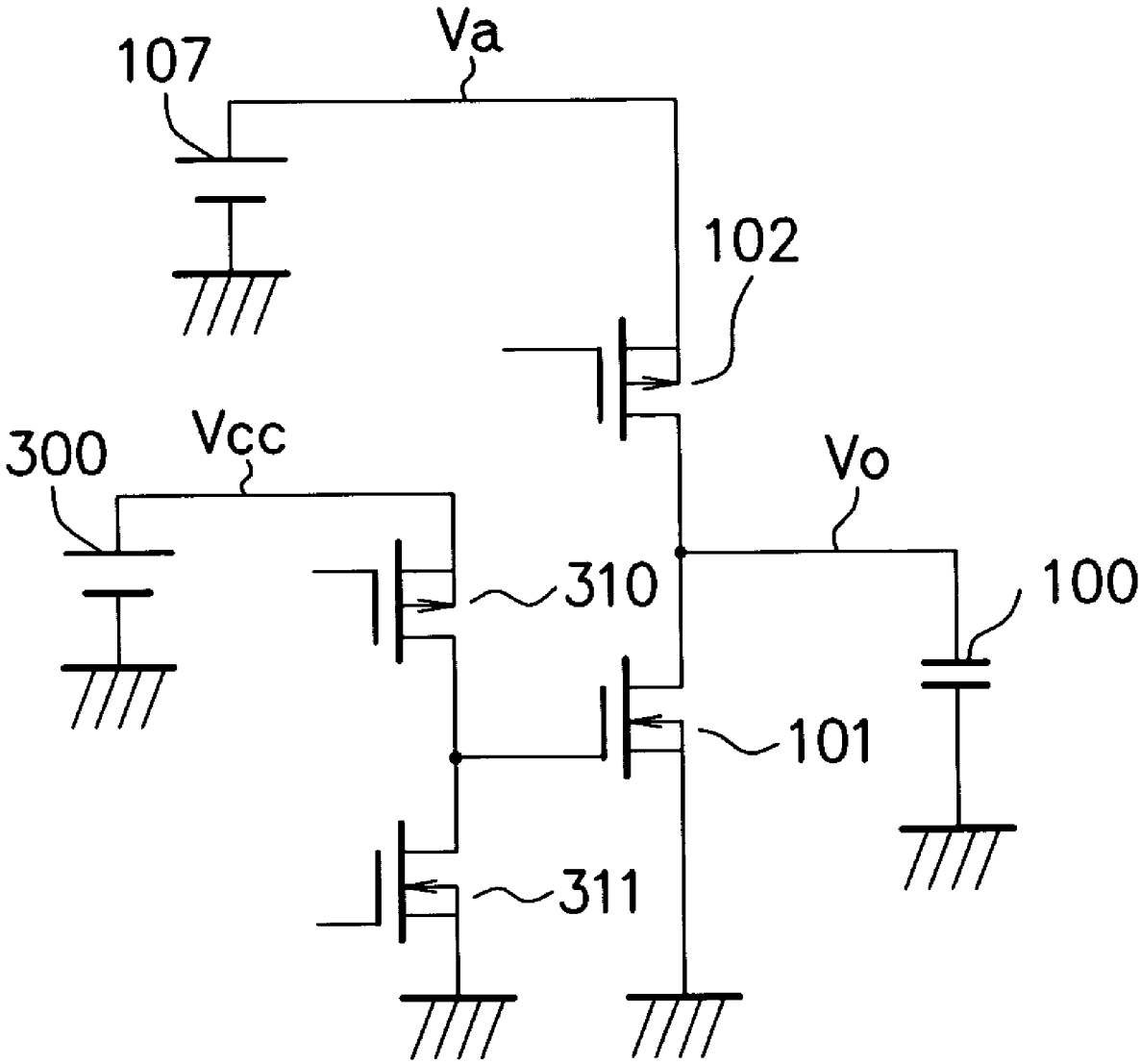
FIG. 3 is a circuit diagram of a load drive circuit according to a second embodiment of the present invention.

FIG. 3 is a circuit diagram of a load drive circuit successful in suppressing load-variation-induced changes in the drive speed, according to the second embodiment of the present invention. In FIG. 3, the constituents same as those appeared in FIG. 1 were given with the same reference numerals or symbols. The P-channel MOSFET 310 corresponds with the current source 110 in FIG. 1, and the N-channel MOSFET 311 corresponds with the switch circuit 111 in FIG. 1. The P-channel MOSFET 310 has the source connected to an anode of a low-voltage power source 300, and the drain to the gate of the N-channel MOSFET 101. The low-voltage power source 300 has a cathode at the ground potential, and the anode at positive potential Vcc (e.g., 5 V). The N-channel MOSFET 311 has the source connected to the ground potential point, and the drain to the gate of the N-channel MOSFET 101.

Figure 4A:
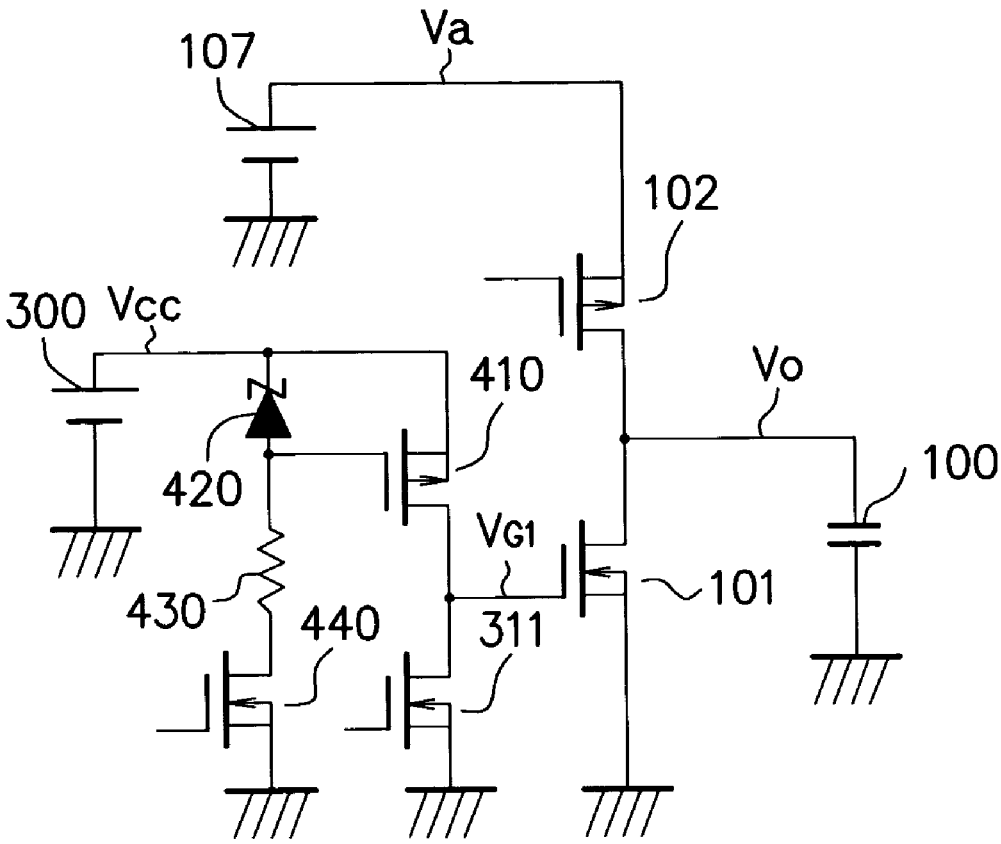
FIGS. 4A and 4B are circuit diagram and characteristic chart of drain current, respectively, according to a third embodiment of the present invention.
Figure 4B:
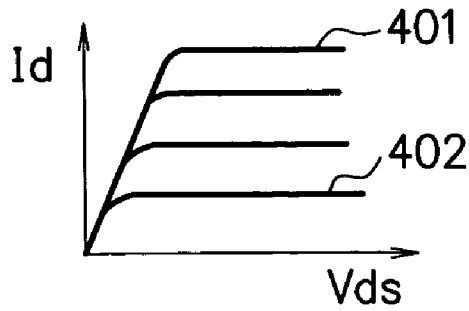

The P-channel MOSFET 310 is a drive element which can operate so as to output an output saturation current (constant current) 401 shown in FIG. 4B typically upon being applied with 5V through the gate and source, to thereby drive the N-channel MOSFET 101. In FIG. 4B, drain-source voltage Vds is plotted on the abscissa, and drain current (output current) Id on the ordinate.

In the configuration shown in FIG. 3, the low-side output element 101 under an activated state is applied with voltage Vcc of the low-voltage power source 300 at the input terminal through the drive element 310. The low-side output element 101 under cut-off state is applied with the ground level, which is same as the reference level for the low-side output element 101, at the input terminal through the drive element 311. Design of the drive element 310 such as allowing it to suppress the output saturation current to VaCμ/Tf makes it possible to assume that the drive element 310 can operate similarly to the current source 110 shown in FIG. 1. The drive element 311 can be used as the switch circuit 111 when it is designed to have a saturation current large enough to quickly cut the low-side output element 101 off.

Third Embodiment

FIG. 4A is a circuit diagram of a load drive circuit successful in suppressing load-variation-induced changes in the drive speed, according to the third embodiment of the present invention. In all drawings explained hereinafter, the constituents same as those appeared in the previous drawings will be given with the same reference numerals or symbols. In FIG. 4A, a P-channel MOSFET 410, a Zener diode 420, a resistor 430 and an N-channel MOSFET 440 are provided in place of the P-channel MOSFET 310 shown in FIG. 3. The P-channel MOSFET 410 has the source connected to the anode of the low-voltage power source 300, and the drain to the gate of the N-channel MOSFET 101. The Zener diode 420 has the anode connected to the gate of the P-channel MOSFET 410, and the cathode to the anode of the low-voltage power source 300. The resistor 430 is connected between the gate of the P-channel MOSFET 410 and the drain of N-channel MOSFET 440. The N-channel MOSFET 440 can operate as a switch circuit, and has the source connected to the ground potential point.

The drive circuit shown in FIG. 4A is characterized in reducing the drive voltage to be applied to the drive element 410 which functions as a current source during activation of the low-side output element 101 by using the Zener diode 420. The gate of the MOSFET 410 is typically applied with 1.5 V. When the drive element 410 is turned on, Zener voltage generated in the Zener diode 420 with the aid of the switch element 440 and the resistor 430 is applied between the input terminal and the reference potential application terminal. For example, for the case where a general active element such as MOSFET or IGBT is used as the drive element 410, suppression of the drive voltage of the active element lower than the maximum drive voltage is successful in expanding the output voltage range (operational range) over which the active element can function as a current source. This means that reduction in the drive voltage of the active element can expand the output voltage range over which an appropriate voltage can be applied between the input and output terminals. The drive circuit is therefore successful in keeping the output current of the drive element 410 constant over a wide range of input voltage VG1 to the low-side output element 101, and in further suppressing variation in the drive speed as being affected by magnitude of the load 100.

For example in FIG. 4B, drain current 401 of the MOSFET 410 is a current under a high gate-source voltage, and drain current 402 is a current under a low gate-source voltage. Suppression of the gate-source voltage of the MOSFET 410 lower than the maximum voltage can successfully expand a range of source-drain voltage Vds of the output saturation current.

It is of course possible to reduce the drive voltage of the drive element 410 by replacing the Zener diode 420 shown in FIG. 4A with a general constant-voltage element such as diode or constant-voltage circuit, or with a resistor.

Fourth Embodiment

Figure 5:
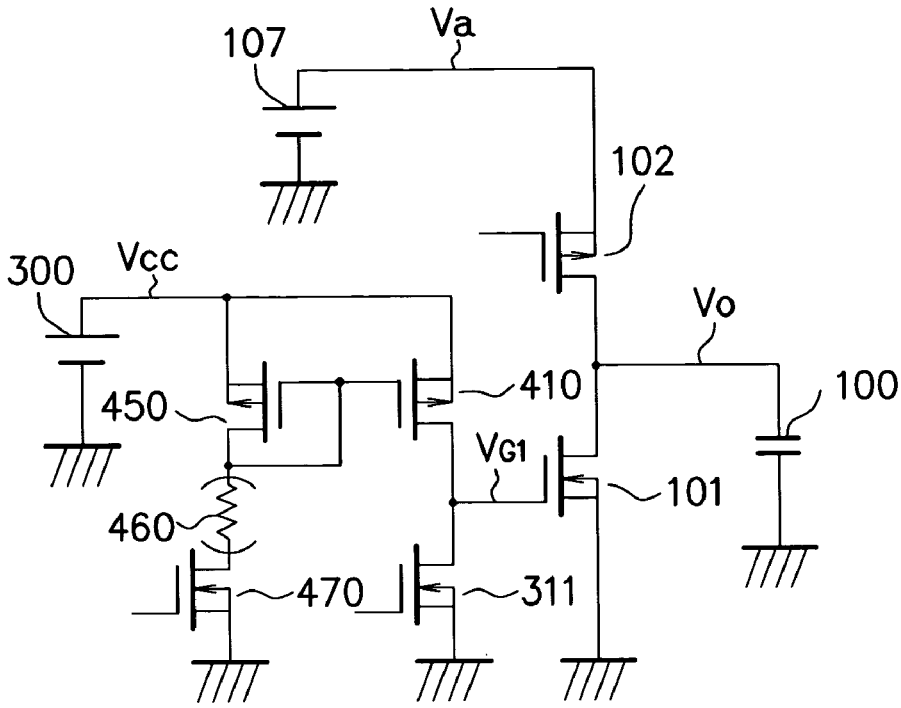
FIG. 5 is a circuit diagram of a load drive circuit according to a fourth embodiment of the present invention.

FIG. 5 is a circuit diagram of a load drive circuit successful in suppressing load-variation-induced changes in the drive speed, according to the fourth embodiment of the present invention. In FIG. 5, P-channel MOSFETs 410, 450, a resistor 460 and an N-channel MOSFET 470 are provided in place of the P-channel MOSFET 310 shown in FIG. 3. The P-channel MOSFET 410 has the source connected to the anode of the low-voltage power source 300, and the drain to the gate of the N-channel MOSFET 101. The P-channel MOSFET 450 has the gate connected to the anode of the low-voltage power source 300, and has the gate and drain connected with each other. The gates of the MOSFETs 410, 450 are connected with each other. The MOSFETs 410, 450 composes a current mirror circuit. The resistor 460 is connected between the drain of the P-channel MOSFET 450 and the drain of the N-channel MOSFET 470. The N-channel MOSFET 470 is a switch circuit, and has the source connected to the ground potential point.

In the drive circuit shown in FIG. 5, drive voltage to be applied to the drive element 410 is generated by a high-precision circuit configuration suitable for integration. That is, by supplying the drive element 450 under diode connection with a current equivalent to the current to be supplied to the drive element 410, through the switch element 470 and resistor 460, it is made possible to precisely supply the drive voltage of the low-side output element 101 to the drive element 410. Formation of the drive element 450 and drive element 410 on a single IC chip based on the same configuration is now successful in making close coincidence of characteristics between these drive elements. It is also made possible to keep the output current of the drive element 410 constant over a wide range of input voltage VG1 to the low-side output element 101 similarly to the drive circuit shown in FIG. 4A, by designing output currents of the drive element 450 and drive element 410 smaller than the output saturation current obtained under voltage Vcc applied between the input terminals and reference potential application terminals of these elements. The drive element 450 and drive element 410 compose a current mirror circuit which is widely used in integrated circuits, and it is of course allowable to adopt any other kind of current mirror circuit provided that current to be supplied to the drive element 410 is equivalent. For example, it is also possible to halve current of the drive element 450 by shrinking (downsizing) the structure of the drive element 450 to a half of that of the drive element 410. It is still also possible to omit the resistor 460 which determines current to be supplied to the drive element 450 and to thereby downscale the circuit, by directly connecting the output terminal of the switch element 470 to the input terminal of the drive element 450, and by designing the output saturation current of the switch element 470 as being equal to current to be supplied to the drive element 410.

Fifth Embodiment

Figure 6:
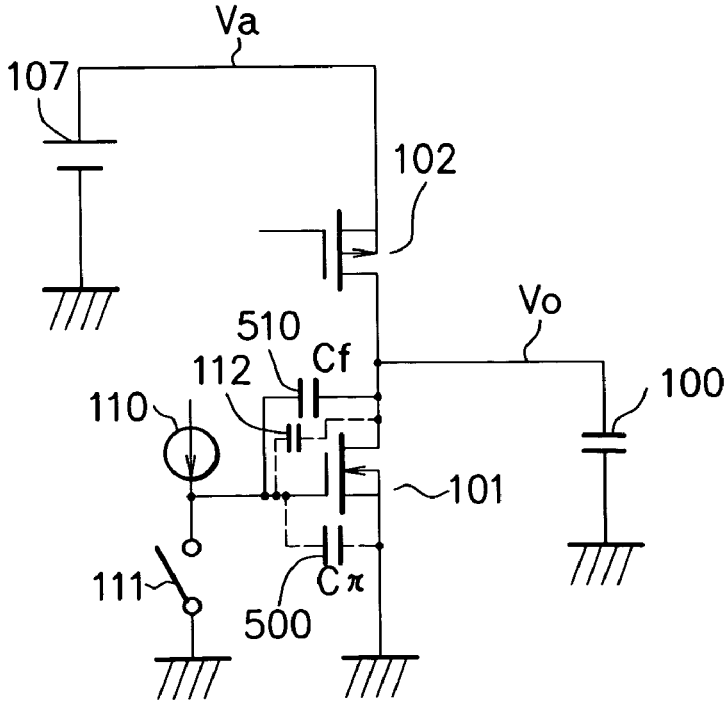
FIG. 6 is a circuit diagram of a load drive circuit according to a fifth embodiment of the present invention.

FIG. 6 is a circuit diagram of a load drive circuit successful in suppressing load-variation-induced changes in the drive speed, according to the fifth embodiment of the present invention. FIG. 6 shows a circuit configured so that a feedback capacitor 510 having a capacitance value of Cf is added to the circuit shown in FIG. 1. The feedback capacitor 510 is additionally connected in parallel with the parasitic capacitance 112 between the gate and drain of the N-channel MOSFET 101, and is configured typically by disposing an insulating material between aluminum electrodes.

The drive circuit shown in FIG. 6, additionally having the feedback capacitor 510 between the input and output terminals of the low-side output element 101, is successful in further suppressing changes in the drive speed ascribable to load variation, and in improving accuracy in setting of the drive speed. A parasitic capacitance 500 having a capacitance value of $C\pi$ generally resides between the input terminal and the reference potential application terminal of the low-side output element 101. The parasitic capacitance 500 is, however, negligible in most cases because an effective input capacitance of the low-side output element 101 in the inverting amplification operation used in the present embodiment is determined by the parasitic capacitance 112 between the input and output terminals, which seems to be multiplied by the degree of voltage amplification based on the mirror effect. Whereas there may be a case in which the drive speed required for the drive circuit is extremely large, so that further suppression of changes in the drive speed ascribable to load variation is necessary in order to suppress unnecessary radiation. In the present embodiment, the suppressive effect of load-variation-induced changes in the drive speed is more enhanced as the amount of negative feedback through the parasitic capacitance 112 between the input and output terminals of the output element 101 grows larger. The amount of negative feedback in the present embodiment can be increased as the ratio of static capacitance between the input and output terminals of the output element 101 to static capacitance between the input terminal and reference potential application terminal grows larger. Connection of the additional feedback capacitor 510 between the input terminal and reference potential application terminal of the output element 101 is therefore successful in further suppressing the load-variation-induced changes in the drive speed. The addition of the feed back capacitor 510 is also successful in improving accuracy in the setting of the drive speed even when a product of the degree of voltage amplification of the output element 101 and capacitance value $C\mu$ of the parasitic capacitance 112 cannot be raised sufficiently larger than capacitance value $C\pi$ of the parasitic capacitance 500.

Sixth Embodiment

Figure 7:
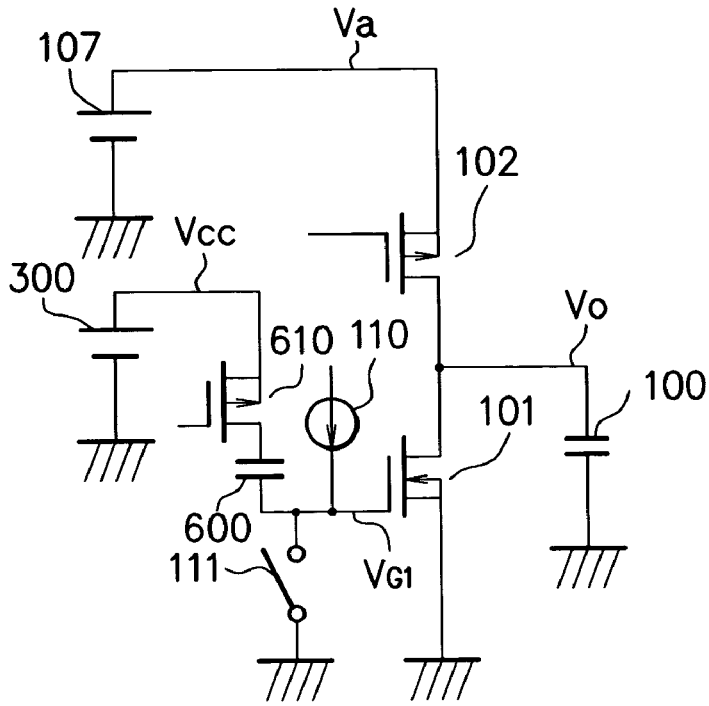
FIG. 7 is a circuit diagram of a load drive circuit according to a sixth embodiment of the present invention.

FIG. 7 is a circuit diagram of a load drive circuit successful in suppressing load-variation-induced changes in the drive speed, according to the sixth embodiment of the present invention. FIG. 7 shows a circuit configured so that the low-voltage power source 300, a P-channel MOSFET 610 and a start-up capacitor (electrostatic capacitance) 600 are added to the circuit shown in FIG. 1. The P-channel MOSFET 610 is a switch circuit, and has the source connected to the anode at positive potential Vcc (reference potential point) of the low-voltage power source 300. The start-up capacitor 600 is connected between the drain of the P-channel MOSFET 610 and the gate of the N-channel MOSFET 101.

In the drive circuit shown in FIG. 7, the drive power source 300 is connected through the switch element 610 and start-up capacitor 600 to the input terminal of the low-side output element 101, for the purpose of quickly raising input voltage VG1 for the low-side output terminal 101 up to threshold voltage Vth to thereby turn the low-side output element 101 on. The quick rise-up of input voltage VG1 of the output element 101 up to threshold voltage Vth after phasing from the period TB into TA shown in FIG. 2 is successful in reducing control delay time, amount of temperature drift thereof and product-wise variation in switching of the drive circuit, and this ensures a circuit design based on reduced unnecessary radiation through suppression of the drive speed.

In an exemplary case where a MOSFET is used for the switch element 610, capacitance value Cs of the start-up capacitor 600 can be adjusted to Vth×Cin/(Vcc−Vth), where Cin denotes total input capacitance parasitic to the input terminal line of the low-side output element 101. Although capacitive element such as capacitor is of course applicable to the start-up capacitor 600, it is also allowable to adopt cross capacitance among a plurality of wiring patterns on integrated circuit chip or printed circuit board. It is still also allowable to form a plurality of input electrodes to the low-side output element 101, and to use one of the electrode and the relevant parasitic capacitance. For example, double gate structure can be adopted for the low-side output element 101 composed of a MOSFET or IGBT. In the drive circuit shown in FIG. 7, the switch element 610 is once turned on within a period up to a timing immediately before the low-side output element 101 is turned on, and the switch element 610 is then turned off after input voltage VG1 of the output element 101 reached threshold voltage Vth. This way of control allows the start-up capacitor 600 to be discharged to zero volt through the current source 110 and a parasitic diode between the source and drain of the MOSFET composing the switch element 610. For the case where the switch element 610 is configured by using an element such as IGBT, which is intrinsically not associated by the parasitic diode, the control can be effected by adding, in parallel therewith, a separate diode and switch circuit similarly to the configuration using MOSFET.

Seventh Embodiment

Figure 8:
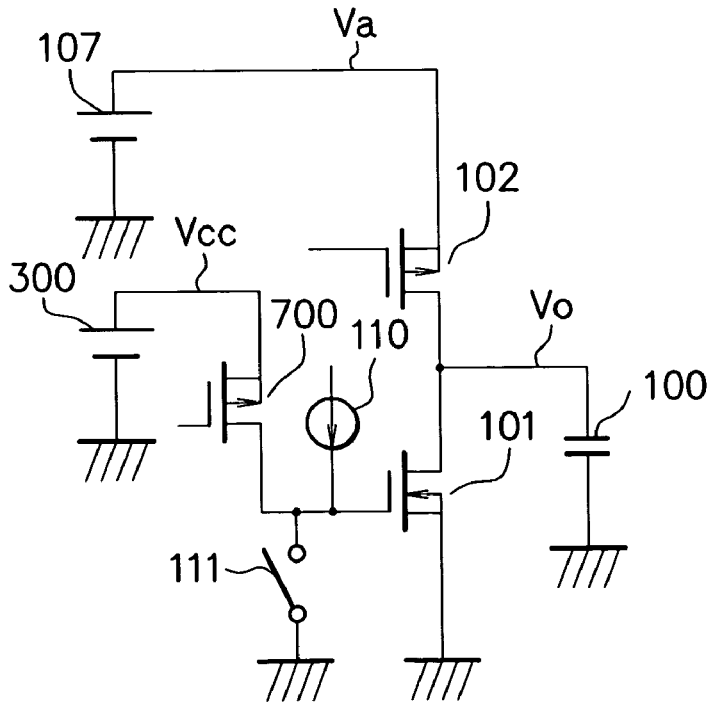
FIG. 8 is a circuit diagram of a load drive circuit according to a seventh embodiment of the present invention.

FIG. 8 is a circuit diagram of a load drive circuit successful in suppressing load-variation-induced changes in the drive speed, according to the seventh embodiment of the present invention. FIG. 7 shows a circuit configured so that the low-voltage power source 300 and the P-channel MOSFET 700 is added to the circuit shown in FIG. 1. The P-channel MOSFET 700 is a switch circuit, and has the source connected to the anode at a positive potential Vcc (reference potential point) of the low-voltage power source 300, and the drain of the gate of the N-channel MOSFET 101.

In the drive circuit shown in FIG. 8, the switch element 700 is turned on to thereby raise input voltage VG1 of the low-side output element 101, only after output voltage Vo of the drive circuit is lowered to a level where the unnecessary radiation is not anticipated. This way of control makes it possible to maximize the drive speed of the drive circuit under a heavy load, and to attain suppression of the unnecessary radiation and high-speed driving at the same time.

Eighth Embodiment

Figure 9:
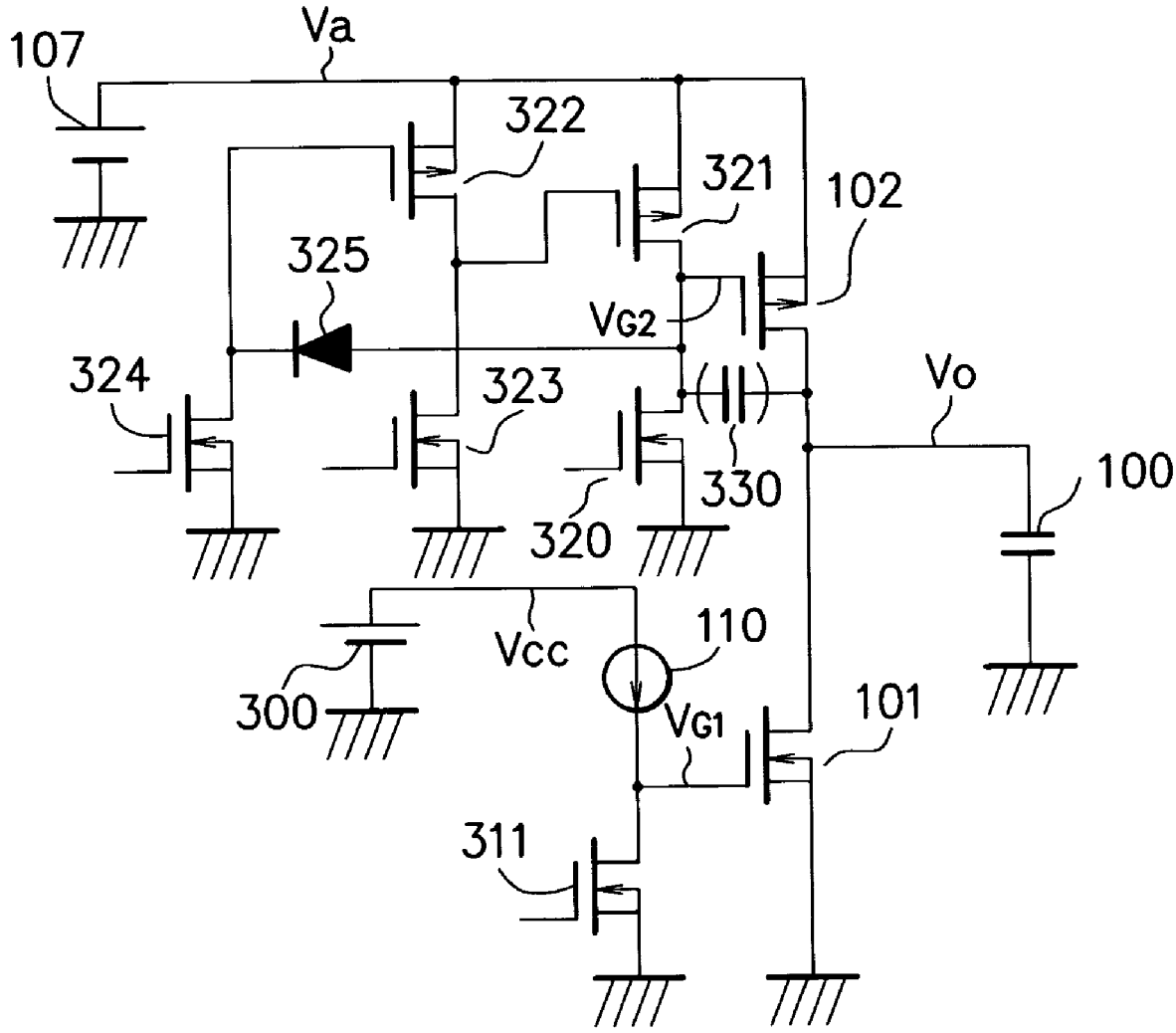
FIG. 9 is a circuit diagram of a load drive circuit according to an eighth embodiment of the present invention.
Figure 10:
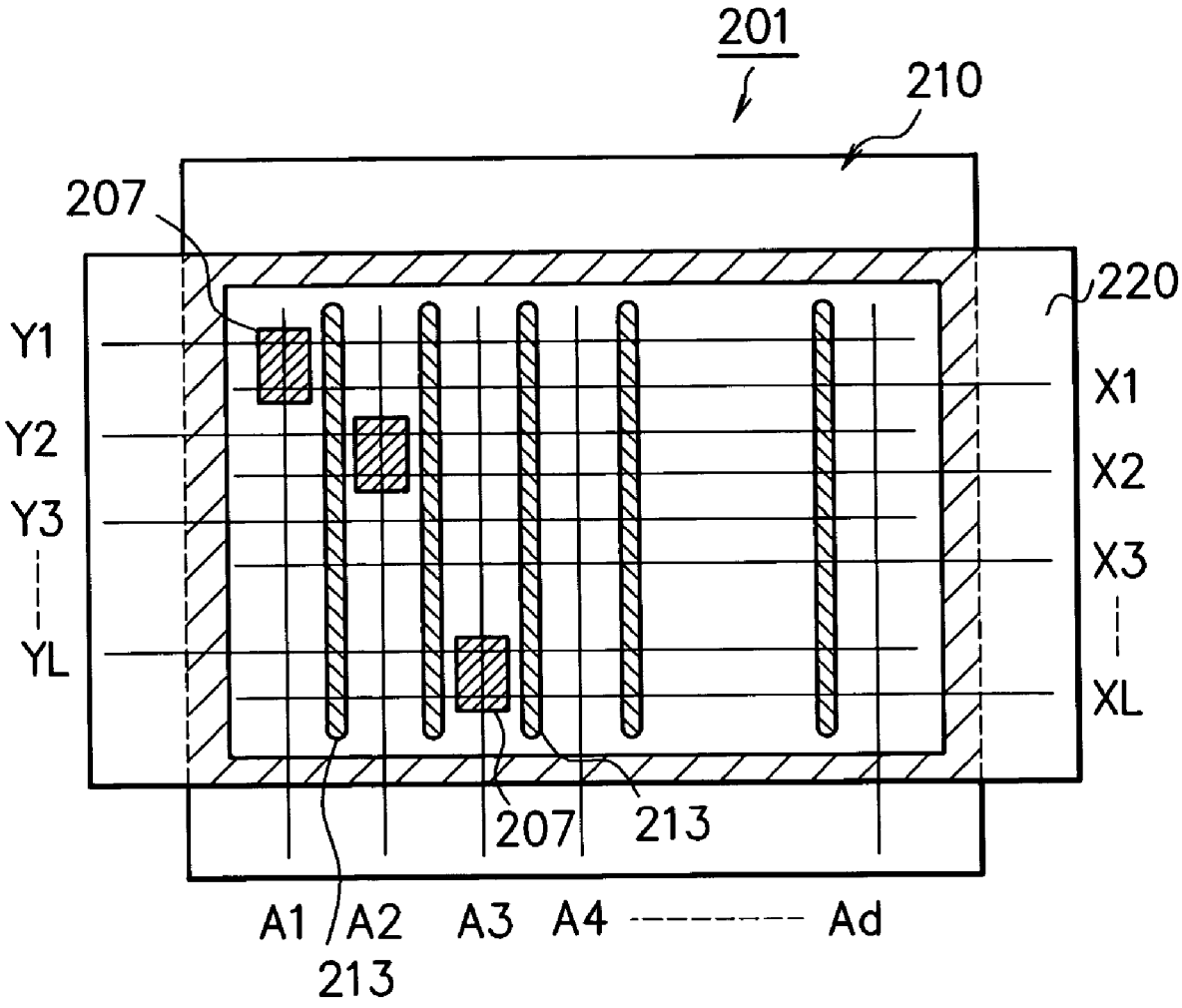
FIG. 10 is a schematic plan view of a surface discharge AC plasma display panel.
Figure 11:
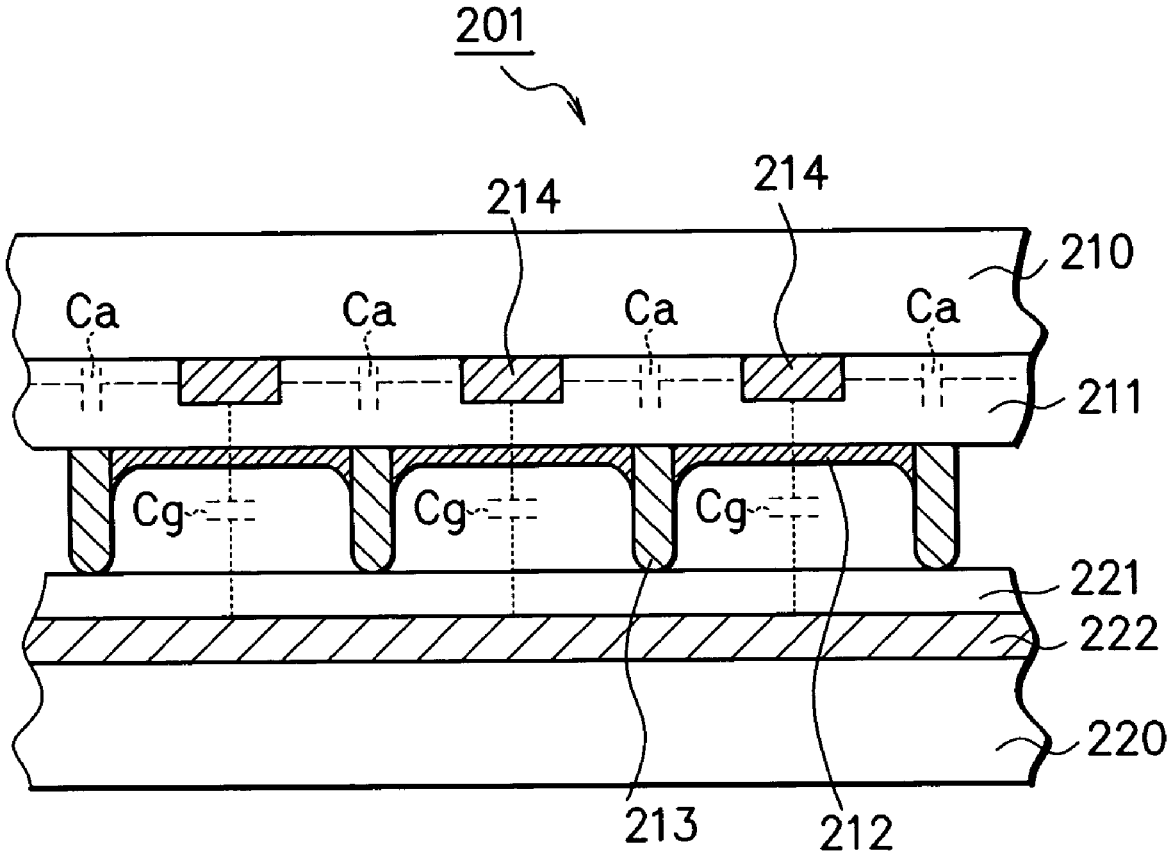
FIG. 11 is a schematic sectional view of a surface discharge AC plasma display panel.

FIG. 9 is a circuit diagram of a load drive circuit successful in suppressing load-variation-induced changes in the drive speed, according to the eighth embodiment of the present invention, where the present invention is applied to the high-side output element 102. A configuration obtained by adding the present embodiment to the circuit shown in FIG. 1 will be explained. An N-channel MOSFET 324 has the source connected to the ground potential point, and the drain to the gate of a P-channel MOSFET 322. The P-channel MOSFET 322 has the source connected to the anode of the drive power source 107, and the drain to the drain of an N-channel MOSFET 323. The source of the N-channel MOSFET 323 is connected to the ground potential point. The P-channel MOSFET 321 is a switch circuit, and has the gate connected to the drain of the MOSFET 322, the source connected to the anode of the drive power source 107, and the drain connected to the anode of the gate of the P-channel MOSFET 102. The N-channel MOSFET 320 is a current source, and has the source connected to the ground potential point, and the drain to the gate of the P-channel MOSFET 102. The diode 325 has the anode connected to the gate of the P-channel MOSFET 102, and the cathode to the gate of the MOSFET 322.

In FIG. 9, input voltage VG2 of the high-side output element 102 at the rise-up time of output voltage Vo is driven by the drive element 320 which can be assumed as a current source of its output saturation current. This circuit configuration makes it possible to effectively use the negative feedback through the parasitic capacitance between the input and output terminals of the high-side output element 102, and to suppress the load-variation-induced changes with respect to the rise-up time of output voltage Vo, based on the operation principle same as that for the circuit previously shown in FIG. 1. In FIG. 9, the MOSFETs 322 to 324 and the diode 325 are added in order to control the drive element 321 which is used for quickly cutting the high-side output element 102 off to thereby suppress through-current-induced increase in the power consumption. That is, the drive element 321 is turned on by turning the MOSFET 323 on, to thereby quickly cut the high-side output element 102 off. The gate voltage raised herein up to high-voltage potential Va through the diode 325 results in cutoff of the MOSFET 322. Turning-on of the high-side output element 102 for raising output voltage Vo is effected by first turning the MOSFET 323 off, then turning the MOSFET 324 and MOSFET 322 on to thereby cut the drive element 321 off, and then turning the drive element 320 on.

For the purpose of further suppressing the load-variation-induced changes in the drive speed at the rise-up time of output voltage Vo, and of further improving accuracy in the setting of the drive speed, it is also allowable to add a feedback capacitor 330, indicated in the parentheses in FIG. 9, in parallel with the parasitic capacitance between the gate and drain of the MOSFET 102. Operation of the feedback capacitor 330 is same as described in the embodiment of the circuit previously shown in FIG. 6. It is therefore a matter of course that the present invention is applicable to both of the low-side output element 101 and high-side output element 102 at the same time.

Also the high-side output element 102 is connected so as to enable inverting amplification operation similarly to the low-side output element 101. It is therefore made possible, also in any aforementioned embodiments including this embodiment, to suppress the load-variation-induced influences on the rise-up waveform of output voltage Vo, by connecting both of a current source 320 for supplying current in the direction of current supply through the high-side output element 102 and a switch circuit 321 for enhancing the cut-off control to the input terminal of the high-side output element 102.

Ninth Embodiment

Figure 16:
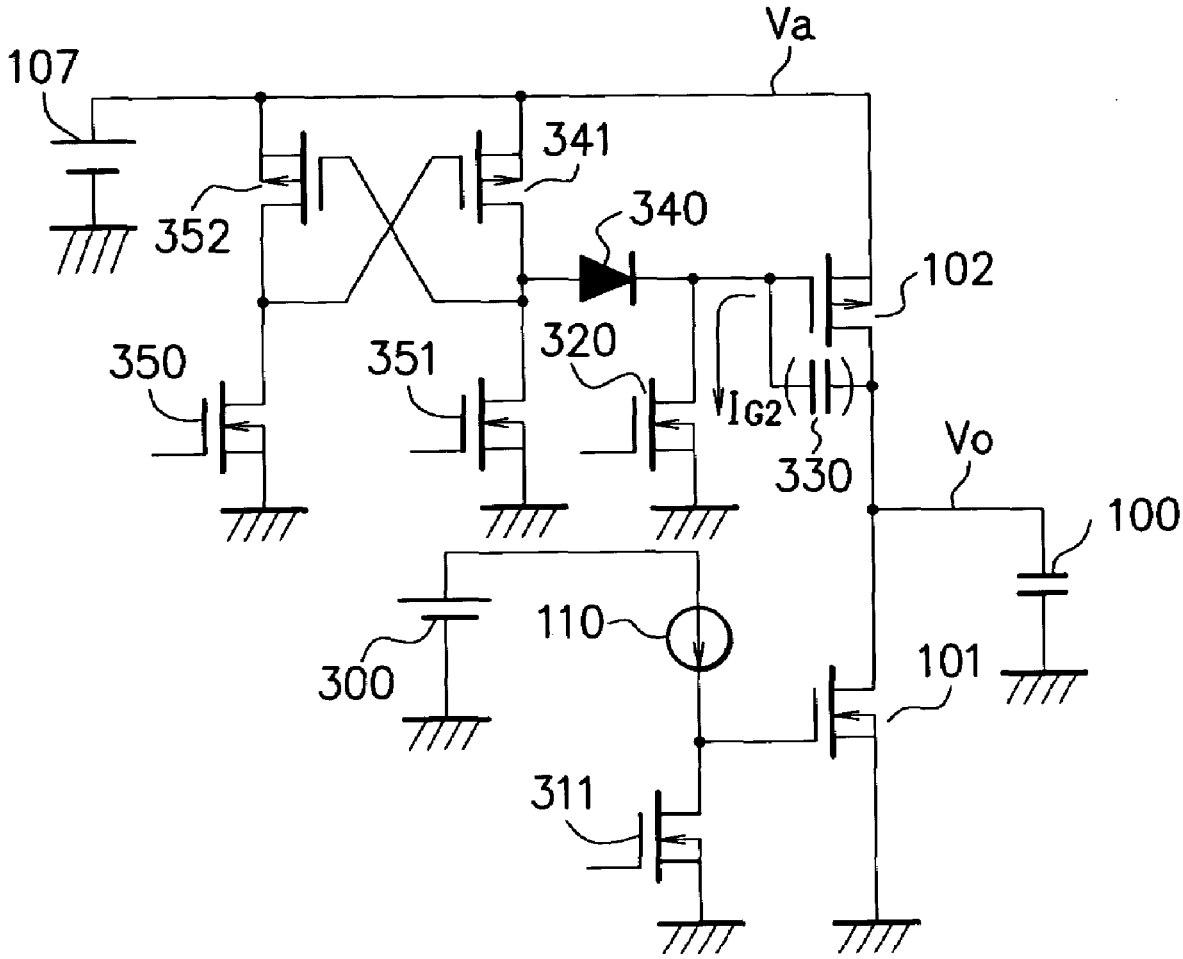
FIG. 16 is a circuit diagram of a load drive circuit according to a ninth embodiment of the present invention.

FIG. 16 is a circuit diagram of a load drive circuit successful in suppressing load-variation-induced changes in the drive speed, according to the ninth embodiment of the present invention, wherein the present invention is applied to the high-side output element 102. Elements added to the circuit shown in FIG. 3 (FIG. 1) in the present embodiment will be explained. An N-channel MOSFET 350 has the source connected to the ground potential point, and the drain to the drain of a P-channel MOSFET 352. The P-channel MOSFET 352 has the gate connected to the anode of the diode (unidirectional conductive element) 340, and the source to the anode of the drive power source 107. An N-channel MOSFET 351 has the source connected to the ground potential point, and the drain to the anode of the diode 340. A P-channel MOSFET 341 has the gate connected to the drain of the MOSFETs 352 and 350, the source to the anode of the drive power source 107, and the drain to the anode of the diode 340. The cathode of the diode 340 is connected to the gate of the P-channel MOSFET 102. The N-channel MOSFET 320 is a current source, and has the source connected to the ground potential point, and the drain to the gate of the P-channel MOSFET 102.

Figure 17:
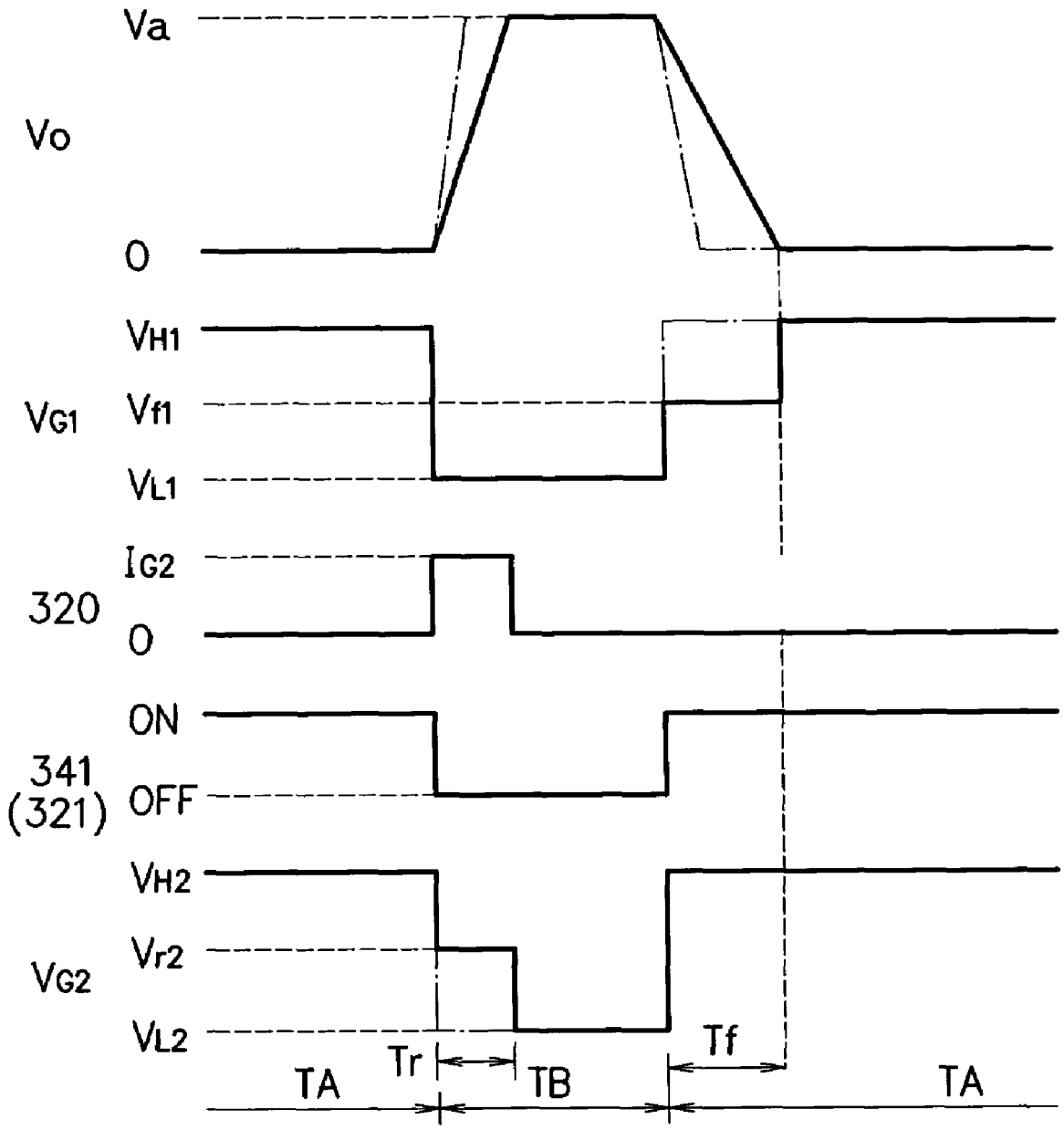
FIG. 17 is a timing chart explaining circuit operation according to the ninth embodiment of the present invention.

Operation during the address period ADD (FIG. 13) of the circuit shown in FIG. 16 will be explained referring to the timing chart of FIG. 17. FIG. 17 shows, from the top to the bottom, output voltage Vo, gate voltage VG1 of the N-channel MOSFET 101, source-drain current of the N-channel MOSFET 320, ON/OFF operation of the P-channel MOSFET (switch element) 341, and gate voltage VG2 of the P-channel MOSFET 102.

In the period TB, the low-side output element 101 is quickly cut off by allowing the input voltage VG1 to quickly fall from high-voltage potential VH1 down to low-voltage potential VL1. Gate voltage of the N-channel MOSFET 350 is then switched from high-voltage potential to low-voltage potential, and this is followed by switching of gate voltage of the N-channel MOSFET 351 from low-voltage potential to high-voltage potential. This turns the MOSFET 350 off, and turns the MOSFET 351 on. Consequently, the MOSFET 341 turns off, and the MOSFET 352 turns on. Current IG2 then flows from the gate of the high-side output element 102 via the MOSFET 320 to the ground potential point. Input voltage VG2 of the high-side output element 102 descends from high-voltage potential VH2 down to the threshold voltage, and is sustained nearly at a constant voltage of Vr2 by virtue of negative feedback through a feedback capacitor. Over the period Tr of the negative feedback, output voltage Vo rises from the ground level to high-voltage potential Va at a nearly constant through rate. So far as the drive current of the load 100 is suppressed equal to or lower than the current ability of the high-side output element 102, the period Tr of the negative feedback is controlled so as to be kept at a constant duration of time irrespective of changes in the load 100. Voltage Vr2 varies depending on level of the capacitive load 100. Larger capacitive load 100 results in higher voltage Vr2, and smaller capacitive load 100 results in lower voltage Vr2, where duration of the period Tr during which output voltage Vo rises from the ground level to high-voltage potential Va is kept almost constant irrespective of changes in the capacitive load 100.

This is consequently successful in suppressing shortening of the transition time observed in wavelength of the drive voltage which possibly occurs when the effective load 100 decreases, and also in preventing unnecessary electromagnetic wave from generating. Use of the drive circuit shown in FIG. 14 may sharpen the rise-up waveform of input voltage VG2 and output voltage Vo of the high-side output element 102 as indicated by a dashed line in FIG. 17 and may result in unnecessary radiation. After the elapse of the period Tr, input voltage VG2 of the high-side output element 102 is lowered to low-voltage potential VL2, current flows through the MOSFET 320 becomes zero, and output voltage Vo rises up to high-voltage potential Va.

Next in the period TA, output voltage Vo is lowered from high-voltage potential Va to the ground level, basically according to the operation same as that shown in FIG. 2. Gate voltage of the N-channel MOSFET 351 herein is set to low-voltage potential, and gate voltage of the N-channel MOSFET 350 is then set to high-voltage potential. This turns the MOSFET 351 off and turns the MOSFET 350 on. Consequently, the MOSFET 352 turns off, and the MOSFET 341 turns on. The high-side output element 102 is cut off because input voltage VG2 is raised up to high-voltage potential VH2.

As described in the above, input voltage VG2 of the high-side output element 102 at the rise-up time of output voltage Vo is driven by the drive element 320 which can be assumed as a current source of its output saturation current. This circuit configuration makes it possible to effectively use the negative feedback typically through the parasitic capacitance between the input and output terminals of the high-side output element 102, and to suppress the load-variation-induced changes with respect to the rise-up time of output voltage Vo, based on the operation principle same as that for the circuit previously shown in FIG. 1. The MOSFETs 350 to 352 and the diode 340 are added in order to control the drive element 341 used for quickly cutting the high-side output element 102 off so as to suppress increase in the power consumption due to through current. More specifically, the drive element 341 is turned on by turning the MOSFET 351 off and then turning the MOSFET 350 on, so as to quickly cut the high-side output element 102 off through the diode 340. In this operation, gate voltage of the MOSFET 352 is raised to high-voltage potential Va by the MOSFET 341, and this cuts also the MOSFET 352 off. To make conduction of the high-side output element 102 which raises output voltage Vo, the MOSFET 341 is cut off by turning the MOSFET 350 off, and then turning the MOSFETs 351 and 352 on. The high-side output element 102 is then brought into conduction by supplying a constant current IG2 through the MOSFET 320, and this results in rise-up of output voltage Vo suppressed in influences by the load capacitance 100. For the purpose of further suppressing load-variation-induced changes in the drive speed at the rise-up time of output voltage Vo, and improving setting accuracy of the drive speed, it is also allowable to add the feedback capacitor 330. Operations of the feedback capacitor 330 are same as those described in the above referring to FIG. 9. As is obvious from the above, the present embodiment makes it possible to apply the present invention both to the low-side output element 101 and high-side output element 102 at the same time.

Tenth Embodiment

Figure 18:
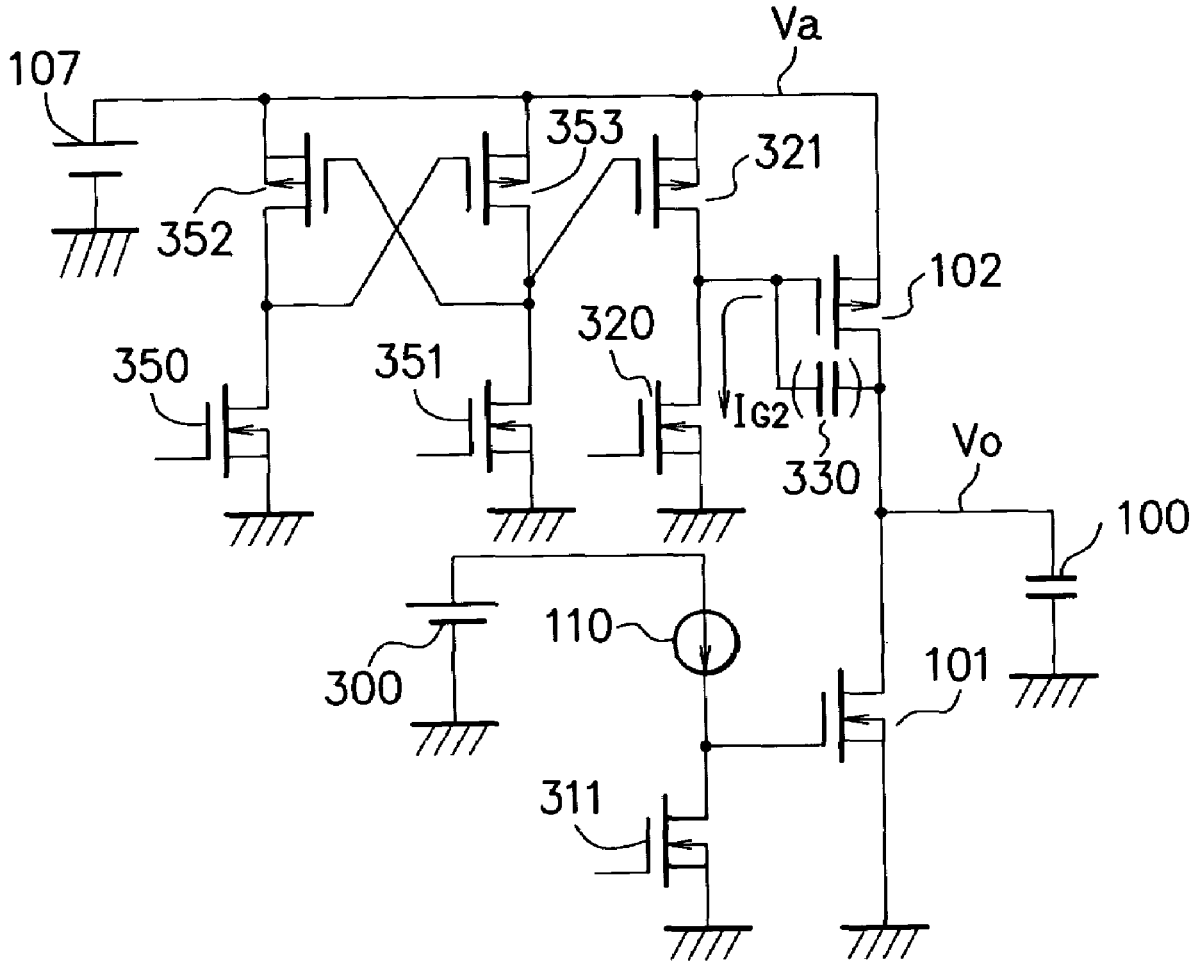
FIG. 18 is a circuit diagram of a load drive circuit according to a tenth embodiment of the present invention.

FIG. 18 is a circuit diagram of a load drive circuit successful in suppressing load-variation-induced changes in the drive speed, according to the tenth embodiment of the present invention, wherein the present invention is applied to the high-side output element 102. Similar to the ninth embodiment, the present embodiment makes it possible to suppress the load-dependent variation with respect to the rise-up time of output voltage Vo, by using the negative feedback through the high-side output element 102. Difference in circuit configuration of the present embodiment from that shown in FIG. 16 will be explained. The circuit shown in FIG. 18 is equivalent to the circuit shown in FIG. 16 except that the diode 340 is omitted and the switch element 321 is added. A P-channel MOSFET 321 functions as a switch element, and has the gate connected to the gate of the MOSFET 352, the source connected to the anode of the drive power source 107, and the drain connected to the gate of the MOSFET 102.

The MOSFET 341 shown in FIG. 16 was renumbered as MOSFET 353 in FIG. 18. This is because the MOSFET 341 in FIG. 16 and the MOSFET 353 in FIG. 18 differ in the functions thereof from each other. The MOSFET 341 in FIG. 16 functions as a switch element, whereas in the circuit shown in FIG. 18, the MOSFET 321, rather than the MOSFET 353, functions as a switch element. Operation of the switch element 321 in FIG. 18 is same as that of the switch element 341 in FIG. 16, as shown in FIG. 17. More specifically, gate voltage of the MOSFETs 350 and 351 in FIG. 18 basically equals to a logical inversion of gate voltage in FIG. 16. This makes it possible for the present embodiment to perform operations similar to those of the circuit shown in FIG. 16, as shown in FIG. 17.

As described in the above, use of the MOSFET 321 makes it possible to quickly and safely cut the high-side output element 102 off. That is, the high-side output element 102 is rapidly driven under a low impedance directly by the MOSFET 321 without being mediated by any passive elements such as diode. This is also advantageous in minimizing voltage drop which possibly appears on any passive element such as diode, and in stably keeping the cut-off state of the high-side output element 102.

Eleventh Embodiment

Figure 19:
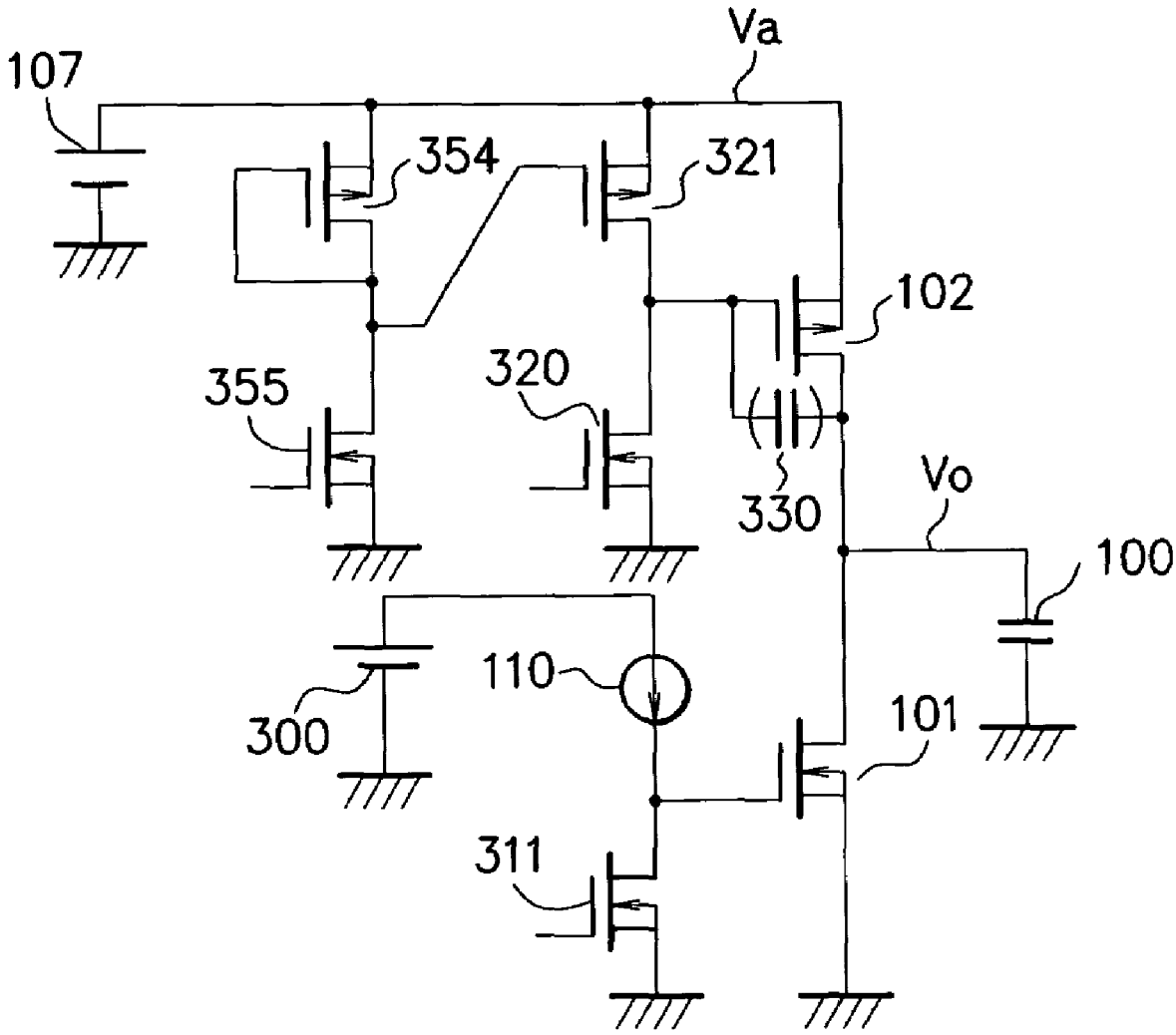
FIG. 19 is a circuit diagram of a load drive circuit according to a eleventh embodiment of the present invention.

FIG. 19 is a circuit diagram of a load drive circuit successful in suppressing load-variation-induced changes in the drive speed, according to the eleventh embodiment of the present invention, wherein the present invention is applied to the high-side output element 102. The present embodiment shows a circuit reduced in the circuit scale as compared with the ninth and tenth embodiments, and thereby succeeded in cost reduction. Elements added to the circuit shown in FIG. 3 (FIG. 1) in the present embodiment will be explained.

A P-channel MOSFET 354 has the source connected to the anode of the drive power source 107, and the gate and the drain connected to the gate of the MOSFET 321. An N-channel MOSFET 355 has the source connected to the ground potential point, and the drain to the gate of the MOSFET 321. The P-channel MOSFET 321 has the source connected to the anode of the drive power source 107, and the drain to the gate of the MOSFET 102. The N-channel MOSFET 320 has the source connected to the ground potential point, and the drain to the gate of the MOSFET 102.

Operations of the MOSFETs 320 and 321 are same as those in the circuit shown in FIG. 18. The MOSFET 354 functions as a resistor. Gate voltage of the MOSFET 355 set to high-voltage potential turns the MOSFET 321 on, and set to low-voltage potential turns the MOSFET 321 off. This allows operations similar to those in the ninth and tenth embodiments, as shown in FIG. 17.

As is obvious from the above, operation of the MOSFET 321, which quickly and safely cuts the high-side output element 102 off, is controlled by a simple inverter circuit composed of the MOSFETs 354 and 355. Although the MOSFET 354 was exemplified as a passive load such as of enhancement type or depression type used in diode connection, it is also allowable to use a single element such as resistor or the like. In the circuit, only an instantaneous conduction of the MOSFET 355 is enough to keep the cut-off state of the high-side output element 102 having electric charge at the input terminal thereof already been discharged through the MOSFET 321. This consequently makes it possible to provide a low-power circuit suppressed in power consumption in the inverter circuit composed of the MOSFETs 354 and 355, similarly to the ninth and tenth embodiments. It is to be noted that it is also allowable to add the feedback capacitor 330 similarly to as shown in FIG. 9. Operations of the feedback capacitor are same as those given in the description of FIG. 9. The present embodiment is advantageous in reducing the circuit scale and the cost because only a small number of elements are used.

The foregoing paragraphs have described the embodiments of the present invention, where it is of course allowable to invert the polarity of the individual elements composing the individual embodiments to thereby invert the positive/negative direction of the power source voltage. The foregoing paragraphs have described the cases in which MOSFET and diode were used as the drive element and semiconductor element composing the individual embodiments. However it is of course allowable to replace the drive element and semiconductor element with IGBT, bipolar transistor, junction FET and vacuum tube, all of which are known to those skilled in the art (engineers) as having functions equivalent to those of the elements. Similarly for the display device which were considered as drive targets in the individual embodiment, it is obvious that a plasma display panel, liquid crystal panel, organic/inorganic electroluminescence panel, field emission display (FED) panel and so forth, all of which have matrix electrodes and can be assumed as variable loads, are adoptable. Possible examples of the load to be driven include cathode electrode and grid electrode of color cathode ray tube showing a plurality of capacitive impedances corresponded to three primary colors of RGB, and the individual drive electrodes of a large number of emission tubes arranged on the display surface of wall-type plasma displays not limited to flat-type ones.

Figure 12:
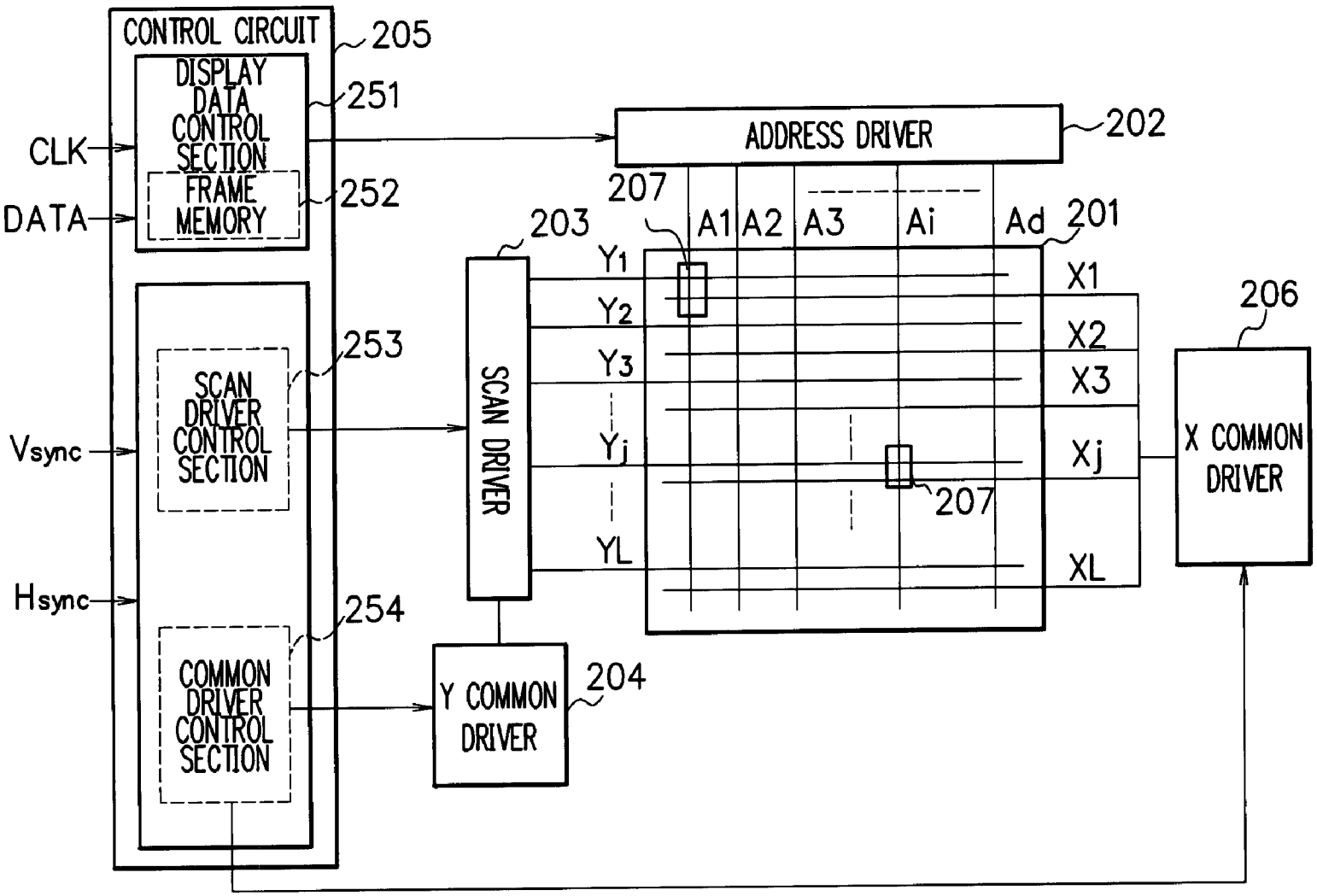
FIG. 12 is a block diagram showing a drive circuit of a surface discharge AC plasma display panel.
Figure 13:
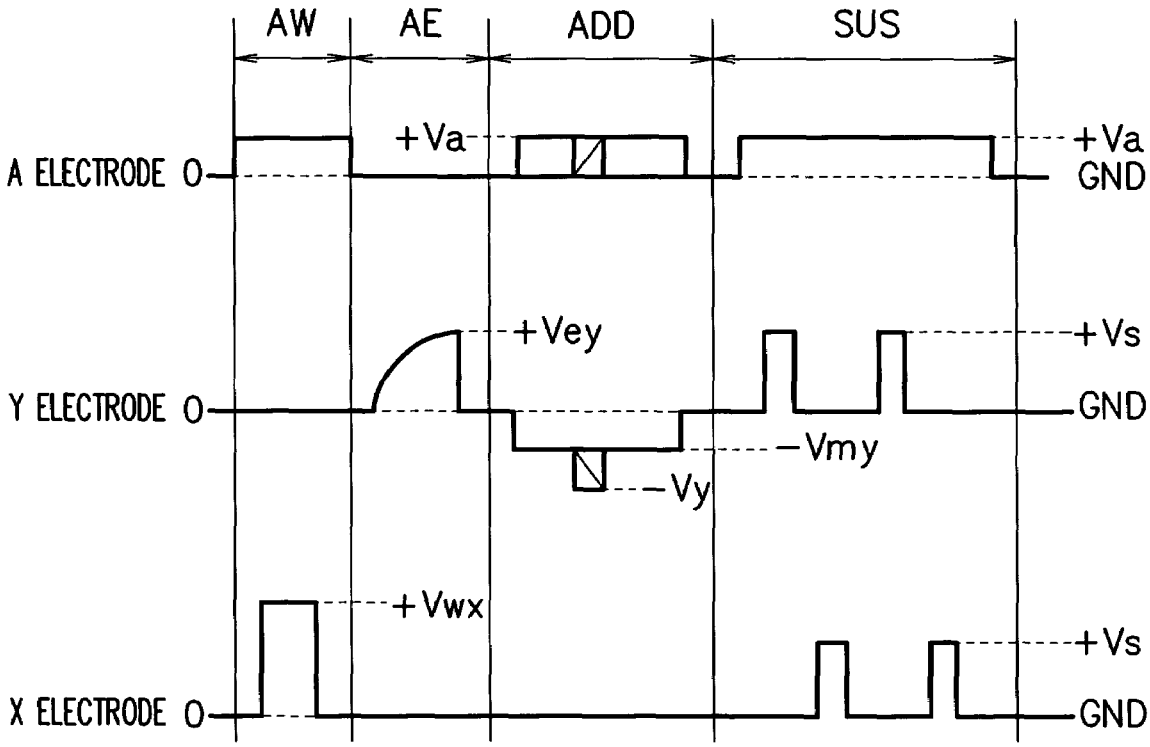
FIG. 13 is a waveform chart showing drive voltage waveforms of a surface discharge AC plasma display panel.

The first to eleventh embodiments showed one load capacitance 100 of a single address electrode and one drive circuit for driving of the load, where the drive circuit is provided for each address electrode for the case where a plurality of address electrodes A1 to Ad are provided as shown in FIG. 12. More specifically, for the purpose of driving a plurality of variable capacitive loads 100, the integrated circuit 121 shown in FIG. 1, which is a combined set of the output element 101, power source 110, switch circuit 311 and so forth, can be provided in a plural number, and the plurality of the combined sets are integrated to thereby produce an all-in-one circuit. In other words, the address driver 202 shown in FIG. 12 can be configured by a single integrated circuit. The load capacitance 100 is not limited to capacitance, and can provide a similar effect even when it is a load other than capacitive one, such as resistor.

In the load drive circuit having the output with an inverting amplification function, connection of a current source to the input terminal of the output element is successful in suppressing the switching speed of the output voltage of the output element to a constant level, by virtue of effect of signal feedback through parasitic capacitance between the input and output terminals of the drive circuit. The suppression of the switching speed contributes to reduction in the unnecessary radiation. The connection of the switch circuit to the input terminal of the output element circuit further makes it possible to quickly cut the drive circuit off. The immediate cut-off of the drive circuit is successful in suppressing currents unnecessary for the switching operation, such as current in the active operational region of the drive circuit and through current generated in the load drive circuit, and consequently in suppressing the power consumption.

The present embodiments are successful in suppressing unnecessary electromagnetic wave radiation due to increase in the drive speed of the drive circuit of the display device even when the effective load of the display device varies depending on displayed images. The present embodiments can therefore reduce the cost for electromagnetic shield or filter circuit which were necessary in view of satisfying the EMI standards in the conventional display. The EMI standards which could not have been satisfied by any conventional HDTV or high-resolution monitor display can be conformable by adopting the first to eleventh embodiments to the display devices.

The connection of the first current source to the input terminal of the drive circuit makes it possible to suppress switching speed of the output voltage of the drive circuit to a constant level, by virtue of effect of signal feedback through parasitic capacitance between the input and output terminals of the drive circuit. The suppression of the switching speed contributes to reduction in the unnecessary radiation. The connection of the first switch circuit to the input terminal of the drive circuit further makes it possible to quickly cut the drive circuit off. The immediate cut-off of the drive circuit is successful in suppressing currents unnecessary for the switching operation, such as current in the active operational region of the drive circuit and through current generated in the load drive circuit, and consequently in suppressing the power consumption.

It is to be noted that the foregoing embodiments are mere examples of materialization for carrying out the present invention, so that the technical scope of the present invention should not limitedly be understood based on these embodiments. In other words, the present invention can be materialized in various modified form without departing from the technical spirit and principal features thereof.

What is claimed is:

1. A load drive circuit comprising:

a first N-channel MOS field effect transistor having a source directly connected to a first reference potential point, the first N-channel MOS field effect transistor inversely amplifying a signal, which is inputted to a gate and outputted from a drain, for driving a load;

a first current source directly connected to the gate and being capable of controlling current output; and a first switch circuit directly connected between the gate and the first reference potential point, wherein the current source is configured to supply a current from the first current source to the gate in order to control a transition time during which an output voltage of the drain falls.

2. The load drive circuit according to claim 1, further comprising a first P-channel MOS field effect transistor having a drain connected to the drain of said first N-channel MOS field effect transistor, and a source connected to a first positive potential point.

3. The load drive circuit according to claim 2, wherein said first current source includes a second P-channel MOS field effect transistor having the drain connected to the gate of said first N-channel MOS field effect transistor, and the source connected to a second positive potential point.

4. The load drive circuit according to claim 3, wherein said first current source further comprises a Zener diode connected between the gate of said second P-channel MOS field effect transistor and said second positive potential point.

5. The load drive circuit according to claim 3, wherein said first current source further comprises a third P-channel MOS field effect transistor having the gate connected to its own drain and the gate of said second P-channel MOS field effect transistor, having the drain connected at least through a switch circuit to said first reference potential point, and having the source connected to the second positive potential point.

6. The load drive circuit according to claim 2, further comprising:

a second N-channel MOS field effect transistor having the gate connected to the gate of said first P-channel MOS field effect transistor and having the source connected to the first reference potential point; and a second switch circuit connected between the gate of said first P-channel MOS field effect transistor and a second reference potential point.

7. The load drive circuit according to claim 1, wherein said first current source comprises a drive element capable of outputting an output saturation current in order to drive said first N-channel MOS field effect transistor.

8. The load drive circuit according to claim 1, wherein said first current source is configured by using a drive element capable of applying the drive voltage as being suppressed under the maximum drive voltage.

9. The load drive circuit according to claim 1, wherein said first current source uses a current mirror circuit.

10. The load drive circuit according to claim 1, further comprising a feedback capacitor additionally connected in parallel with a parasitic capacitance between the gate and the drain of said first N-channel MOS field effect transistor.

11. The load drive circuit according to claim 1, wherein a second positive potential point is connected through an electrostatic capacitance and a second switch circuit to the gate of said first N-channel MOS field effect transistor.

12. The load drive circuit according to claim 1, further comprising a second switch circuit connected between the gate of said first N-channel MOS field effect transistor and a second positive potential point.

13. The load drive circuit according to claim 1, further comprising:

a second N-channel MOS field effect transistor inversely amplifying a signal that is inputted to a gate and outputted from a drain;

a second current source connected to the gate of the second N-channel MOS field effect transistor and being capable of controlling current output; and a second switch circuit connected between the gate of the second N-channel MOS field effect transistor and a second reference potential point, wherein the gate of the first N-channel MOS field effect transistor and the drain of said second N-channel MOS field effect transistor are connected with each other.

14. The load drive circuit according to claim 1, wherein said first switch circuit is connected to the gate of the second N-channel MOS field effect transistor via a unidirectional conductive element.

15. The load drive circuit according to claim 1, wherein said first N-channel MOS field effect transistor is connected to said first reference potential point, and is driven while making a reference to said first reference potential point.

16. The load drive circuit according to claim 1, comprising a plurality of assemblies of said first N-channel MOS field effect transistor, said first current source and said first switch circuit for the purpose of driving a plurality of loads, and being configured so that said plurality of assemblies are integrated and united into a single circuit.

17. The load drive circuit according to claim 1, wherein said load is a capacitive load.

18. The load drive circuit according to claim 1, wherein the load drive circuit is configured to drive a display electrode on a flat-type display panel.

19. The load drive circuit according to claim 1, wherein the load drive circuit is configured to drive a display electrode on a plasma display panel.

20. A load drive circuit, comprising:

a P-channel MOS field effect transistor having a source directly connected to a reference potential point, the P-channel MOS field effect transistor inversely amplifying a signal, which is inputted to a gate and outputted from a drain, for driving a load;

a current source directly connected to the gate and being capable of controlling current output; and a switch circuit directly connected between the gate and the reference potential point, wherein the current source is configured to supply a current from the current source to the gate in order to control a transition time during which an output voltage of the drain falls.

* * * * *